US008725020B2

(12) United States Patent
Fukuzawa et al.

(10) Patent No.: US 8,725,020 B2
(45) Date of Patent: May 13, 2014

(54) IMAGE FORMING APPARATUS HAVING FIXING UNIT FOR FIXING UNFIXED TONER IMAGE FORMED ON RECORDING MATERIAL ONTO RECORDING MATERIAL BY HEAT

(75) Inventors: Daizo Fukuzawa, Mishima (JP); Munehito Kurata, Suntou-gun (JP); Noriaki Sato, Suntou-gun (JP); Kuniaki Kasuga, Mishima (JP); Tomonori Sato, Gotemba (JP); Mahito Yoshioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 342 days.

(21) Appl. No.: 13/301,182

(22) Filed: Nov. 21, 2011

(65) Prior Publication Data

US 2012/0148281 A1 Jun. 14, 2012

(30) Foreign Application Priority Data

Dec. 9, 2010 (JP) ..... 2010-274587

(51) Int. Cl.
*G03G 15/20* (2006.01)

(52) U.S. Cl.
USPC ..... 399/69

(58) Field of Classification Search
USPC ..... 399/38, 67–70, 122, 320, 328, 329
See application file for complete search history.

(56) References Cited

U.S. PATENT DOCUMENTS

| | | | | |
|---|---|---|---|---|
| 5,083,168 | A | 1/1992 | Kusaka et al. | |
| 5,148,226 | A | 9/1992 | Setoriyama et al. | |
| 5,162,634 | A | 11/1992 | Kusaka et al. | |
| 5,262,834 | A | 11/1993 | Kusaka et al. | |
| 5,300,997 | A | 4/1994 | Hirabayashi et al. | |
| 5,343,280 | A | 8/1994 | Hirabayashi et al. | |
| 5,525,775 | A | 6/1996 | Setoriyama et al. | |
| 5,767,484 | A | 6/1998 | Hirabayashi et al. | |
| 6,853,818 | B2 | 2/2005 | Nishida | |
| 7,136,601 | B2 | 11/2006 | Akizuki et al. | |
| 7,630,662 | B2 | 12/2009 | Namiki et al. | |
| 8,615,179 | B2 * | 12/2013 | Yamaguchi et al. | 399/69 |
| 2003/0072581 | A1 | 4/2003 | Nishida | |
| 2004/0033084 | A1 | 2/2004 | Akizuki et al. | |
| 2010/0316404 | A1 | 12/2010 | Fukuzawa et al. | |
| 2011/0150545 | A1 | 6/2011 | Nihonyanagi et al. | |

FOREIGN PATENT DOCUMENTS

| | | | |
|---|---|---|---|
| JP | 63-313182 | A | 12/1988 |
| JP | 02-157878 | A | 6/1990 |
| JP | 04-044075 | A | 2/1992 |
| JP | 04-044076 | A | 2/1992 |
| JP | 06-118838 | A | 4/1994 |
| JP | 09-101718 | A | 4/1997 |
| JP | 09-106215 | A | 4/1997 |
| JP | 10-333490 | A | 12/1998 |
| JP | 11-015303 | A | 1/1999 |

(Continued)

*Primary Examiner* — Hoan Tran

(74) *Attorney, Agent, or Firm* — Fitzpatrick, Cella, Harper & Scinto

(57) ABSTRACT

Corrected power for compensating for a reduction in the temperature of an endless belt that accompanies the entry of a recording material into a fixing nip portion is adjusted by correcting the power supplied to a fixing unit when the recording material enters the fixing unit with a correction power based on the difference between the update time of a power updating period and the time of the entry of the recording material.

4 Claims, 24 Drawing Sheets

(56) References Cited

FOREIGN PATENT DOCUMENTS

| | | | |
|---|---|---|---|
| JP | 2000-268939 | A | 9/2000 |
| JP | 2001-100588 | A | 4/2001 |
| JP | 2003-123941 | A | 4/2003 |
| JP | 2004-078181 | A | 3/2004 |
| JP | 2009-025831 | A | 2/2009 |

* cited by examiner

FIG. 4

| Rt \ wn | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 0% | OFF | OFF | OFF | OFF | OFF | OFF | OFF | OFF | OFF | OFF | OFF | OFF | OFF | OFF | OFF | OFF | OFF | OFF | OFF | OFF |
| 5% | OFF | OFF | OFF | OFF | OFF | OFF | OFF | OFF | OFF | ON | OFF | OFF | OFF | OFF | OFF | OFF | OFF | OFF | OFF | OFF |
| 10% | OFF | OFF | OFF | OFF | ON | OFF | OFF | OFF | OFF | OFF | OFF | OFF | OFF | ON | OFF | OFF | OFF | OFF | OFF | OFF |
| 15% | OFF | OFF | OFF | ON | OFF | OFF | OFF | OFF | OFF | OFF | ON | OFF | OFF | OFF | OFF | OFF | OFF | ON | OFF | OFF |
| 20% | OFF | OFF | ON | OFF | OFF | OFF | OFF | ON | OFF | OFF | OFF | OFF | ON | OFF | OFF | OFF | OFF | ON | OFF | OFF |
| 25% | OFF | OFF | ON | OFF | OFF | ON | OFF | OFF | OFF | OFF | ON | OFF | OFF | ON | OFF | OFF | OFF | OFF | ON | OFF |
| 30% | OFF | OFF | ON | OFF | OFF | ON | OFF | OFF | ON | OFF | OFF | ON | OFF | OFF | ON | OFF | OFF | ON | OFF | OFF |
| 35% | OFF | ON | OFF | OFF | ON | OFF | OFF | ON | OFF | OFF | ON | OFF | OFF | ON | OFF | OFF | ON | OFF | OFF | ON |
| 40% | ON | OFF | OFF | ON | OFF | OFF | ON | OFF | OFF | ON | ON | OFF | OFF | ON | OFF | OFF | ON | OFF | OFF | ON |
| 45% | ON | OFF | OFF | ON | ON | OFF | OFF | ON | ON | OFF | OFF | ON | OFF | OFF | ON | ON | OFF | OFF | ON | OFF |
| 50% | OFF | ON | ON | OFF | OFF | ON | ON | OFF | OFF | ON | ON | OFF | OFF | ON | ON | OFF | OFF | ON | ON | OFF |
| 55% | OFF | ON | ON | OFF | OFF | ON | ON | OFF | OFF | ON | ON | OFF | ON | ON | OFF | OFF | ON | ON | OFF | ON |
| 60% | OFF | ON | ON | OFF | ON | ON | OFF | ON | ON | OFF | OFF | ON | ON | OFF | ON | ON | OFF | ON | ON | OFF |
| 65% | ON | OFF | ON | ON | OFF | ON | ON | OFF | ON | ON | OFF | ON | ON | OFF | ON | ON | OFF | ON | ON | OFF |
| 70% | ON | ON | OFF | ON | ON | OFF | ON | ON | OFF | ON | ON | OFF | ON | ON | OFF | ON | ON | OFF | ON | ON |
| 75% | ON | ON | OFF | ON | ON | OFF | ON | ON | ON | ON | OFF | ON | ON | OFF | ON | ON | ON | ON | OFF | ON |
| 80% | ON | ON | OFF | ON | ON | ON | ON | OFF | ON | ON | ON | ON | OFF | ON | ON | ON | ON | OFF | ON | ON |
| 85% | ON | ON | ON | OFF | ON | ON | ON | ON | ON | ON | OFF | ON | ON | ON | ON | ON | ON | OFF | ON | ON |
| 90% | ON | ON | ON | ON | OFF | ON | ON | ON | ON | ON | ON | ON | ON | OFF | ON | ON | ON | ON | ON | ON |
| 95% | ON | ON | ON | ON | ON | ON | ON | ON | ON | OFF | ON | ON | ON | ON | ON | ON | ON | ON | ON | ON |
| 100% | ON | ON | ON | ON | ON | ON | ON | ON | ON | ON | ON | ON | ON | ON | ON | ON | ON | ON | ON | ON |

FIG. 6A

| BASIS WEIGHT (g/m2) | PAPER MODE | DEVIATION AMOUNT Ts–Tt (msec) | POWER SUPPLY RATE ADDITION VALUE Et(%) |
|---|---|---|---|
| 60~70 | THIN PAPER MODE | 70≤Ts–Tt≤100 | 0% |
| | | 30≤Ts–Tt<70 | 0% |
| | | -30≤Ts–Tt<30 | +5% |
| | | -70≤Ts–Tt<-30 | +10% |
| | | -100≤Ts–Tt<-70 | +10% |
| 71~90 | NORMAL MODE | 70≤Ts–Tt≤100 | 0% |
| | | 30≤Ts–Tt<70 | +5% |
| | | -30≤Ts–Tt<30 | +10% |
| | | -70≤Ts–Tt<-30 | +15% |
| | | -100≤Ts–Tt<-70 | +15% |
| 91~128 | THICK PAPER MODE 1 | 70≤Ts–Tt≤100 | +10% |
| | | 30≤Ts–Tt<70 | +20% |
| | | -30≤Ts–Tt<30 | +25% |
| | | -70≤Ts–Tt<-30 | +30% |
| | | -100≤Ts–Tt<-70 | +35% |
| 129~220 | THICK PAPER MODE 2 | 70≤Ts–Tt≤100 | +20% |
| | | 30≤Ts–Tt<70 | +30% |
| | | -30≤Ts–Tt<30 | +35% |
| | | -70≤Ts–Tt<-30 | +40% |
| | | -100≤Ts–Tt<-70 | +45% |

FIG. 6B

| | 8 HALFWAVES MAKING UP 1 CONTROL CYCLE | | | | | | | |
|---|---|---|---|---|---|---|---|---|
| Rt \ wn | 1 | 2 | 3 | 4 | 5 | 6 | 7 | 8 |
| 0% | 0% | 0% | 0% | 0% | 0% | 0% | 0% | 0% |
| 5% | 0% | 0% | 20% | 0% | 0% | 20% | 0% | 0% |
| 10% | 0% | 0% | 40% | 0% | 0% | 40% | 0% | 0% |
| 15% | 0% | 0% | 60% | 0% | 0% | 60% | 0% | 0% |
| 20% | 0% | 0% | 80% | 0% | 0% | 80% | 0% | 0% |
| 25% | 0% | 0% | 100% | 0% | 0% | 100% | 0% | 0% |
| 30% | 20% | 0% | 0% | 100% | 100% | 0% | 0% | 20% |
| 35% | 40% | 0% | 0% | 100% | 100% | 0% | 0% | 40% |
| 40% | 0% | 100% | 0% | 60% | 60% | 0% | 100% | 0% |
| 45% | 0% | 100% | 0% | 80% | 80% | 0% | 100% | 0% |
| 50% | 0% | 100% | 0% | 100% | 100% | 0% | 100% | 0% |
| 55% | 0% | 100% | 100% | 0% | 66% | 54% | 54% | 66% |
| 60% | 100% | 40% | 40% | 100% | 0% | 100% | 100% | 0% |
| 65% | 100% | 60% | 60% | 100% | 0% | 100% | 100% | 0% |
| 70% | 100% | 80% | 80% | 100% | 0% | 100% | 100% | 0% |
| 75% | 100% | 100% | 100% | 100% | 0% | 100% | 100% | 0% |
| 80% | 100% | 100% | 54% | 54% | 100% | 100% | 66% | 66% |
| 85% | 100% | 100% | 64% | 64% | 100% | 100% | 76% | 76% |
| 90% | 100% | 100% | 60% | 60% | 100% | 100% | 100% | 100% |
| 95% | 100% | 100% | 80% | 80% | 100% | 100% | 100% | 100% |
| 100% | 100% | 100% | 100% | 100% | 100% | 100% | 100% | 100% |

FIG. 9

| BASIS WEIGHT ($g/m^2$) | PAPER MODE | DEVIATION AMOUNT Ts−Tt (msec) | POWER SUPPLY RATE ADDITION VALUE Et(%) |
|---|---|---|---|
| 60~70 | THIN PAPER MODE | 70≤Ts−Tt≤100 | 0% |
| | | 30≤Ts−Tt<70 | +5% |
| | | -30≤Ts−Tt<30 | +5% |
| | | -70≤Ts−Tt<-30 | +5% |
| | | -100≤Ts−Tt<-70 | +5% |
| 71~90 | NORMAL MODE | 70≤Ts−Tt≤100 | +5% |
| | | 30≤Ts−Tt<70 | +5% |
| | | -30≤Ts−Tt<30 | +10% |
| | | -70≤Ts−Tt<-30 | +10% |
| | | -100≤Ts−Tt<-70 | +10% |
| 91~128 | THICK PAPER MODE 1 | 70≤Ts−Tt≤100 | +15% |
| | | 30≤Ts−Tt<70 | +20% |
| | | -30≤Ts−Tt<30 | +25% |
| | | -70≤Ts−Tt<-30 | +20% |
| | | -100≤Ts−Tt<-70 | +20% |
| 129~220 | THICK PAPER MODE 2 | 70≤Ts−Tt≤100 | +25% |
| | | 30≤Ts−Tt<70 | +30% |
| | | -30≤Ts−Tt<30 | +35% |
| | | -70≤Ts−Tt<-30 | +30% |
| | | -100≤Ts−Tt<-70 | +30% |

FIG. 10A

| Ts-Tt (msec) | Rt \ wn | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|---|
| 70≤Ts−Tt≤100 | 0% | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | OFF | OFF | OFF | OFF | OFF | OFF | OFF | OFF | ON | OFF | OFF | OFF | OFF | OFF | OFF | OFF |
| | 10% | OFF | OFF | OFF | OFF | OFF | OFF | OFF | OFF | OFF | OFF | OFF | OFF | ON | ON | OFF | OFF | OFF | OFF | OFF | OFF |
| | 15% | OFF | OFF | OFF | OFF | OFF | OFF | OFF | OFF | OFF | OFF | OFF | OFF | ON | ON | OFF | OFF | ON | OFF | OFF | OFF |
| | 20% | OFF | OFF | OFF | OFF | OFF | OFF | OFF | OFF | OFF | OFF | OFF | OFF | ON | ON | OFF | ON | ON | OFF | OFF | OFF |
| | 25% | OFF | OFF | OFF | OFF | OFF | OFF | OFF | OFF | OFF | OFF | OFF | OFF | ON | ON | OFF | ON | ON | OFF | ON | OFF |
| | 30% | OFF | OFF | OFF | OFF | OFF | OFF | OFF | OFF | OFF | OFF | OFF | OFF | ON | ON | OFF | ON | ON | OFF | ON | ON |
| | 35% | OFF | OFF | OFF | OFF | OFF | OFF | OFF | OFF | OFF | ON | OFF | OFF | ON | ON | OFF | ON | ON | OFF | ON | ON |
| | 40% | OFF | OFF | OFF | OFF | OFF | OFF | ON | OFF | OFF | ON | OFF | OFF | ON | ON | OFF | ON | ON | OFF | ON | ON |
| | 45% | OFF | OFF | OFF | ON | OFF | OFF | ON | OFF | OFF | ON | OFF | OFF | ON | ON | OFF | ON | ON | OFF | ON | ON |
| | 50% | ON | OFF | OFF | ON | OFF | OFF | ON | OFF | OFF | ON | OFF | OFF | ON | ON | OFF | ON | ON | OFF | ON | ON |
| | 55% | ON | OFF | OFF | ON | OFF | OFF | ON | OFF | OFF | ON | ON | OFF | ON | ON | OFF | ON | ON | ON | OFF | ON |
| | 60% | ON | OFF | OFF | ON | OFF | OFF | ON | OFF | OFF | ON | ON | OFF | ON | ON | ON | ON | ON | ON | OFF | ON |
| | 65% | ON | OFF | ON | ON | OFF | OFF | ON | OFF | OFF | ON | ON | OFF | ON | ON | ON | ON | ON | ON | OFF | ON |
| | 70% | ON | OFF | ON | ON | OFF | OFF | ON | ON | OFF | ON | ON | OFF | ON | ON | ON | ON | ON | ON | OFF | ON |
| | 75% | ON | OFF | ON | ON | OFF | OFF | ON | ON | OFF | ON | ON | ON | ON | ON | ON | ON | ON | ON | OFF | ON |
| | 80% | ON | ON | OFF | ON | ON | ON | ON | OFF | ON | ON | ON | ON | OFF | ON | ON | ON | ON | OFF | ON | ON |
| | 85% | ON | ON | OFF | ON | ON | ON | ON | OFF | ON | ON | ON | ON | ON | ON | ON | ON | ON | OFF | ON | ON |
| | 90% | ON | ON | OFF | ON | ON | ON | ON | OFF | ON | ON | ON | ON | ON | ON | ON | ON | ON | ON | ON | ON |
| | 95% | ON | ON | ON | ON | OFF | ON | ON | ON | ON | ON | ON | ON | ON | ON | ON | ON | ON | ON | ON | ON |
| | 100% | ON | ON | ON | ON | ON | ON | ON | ON | ON | ON | ON | ON | ON | ON | ON | ON | ON | ON | ON | ON |

FIG. 10B

| Ts-Tt (msec) | Rt \ wn | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|---|
| 30≤Ts−Tt<70 | 0% | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | ON | OFF | OFF | OFF | OFF | OFF | OFF | OFF | OFF | OFF | OFF | OFF | OFF | OFF | OFF | OFF |
| | 10% | OFF | OFF | OFF | OFF | ON | OFF | OFF | OFF | OFF | OFF | OFF | OFF | OFF | OFF | OFF | ON | OFF | OFF | OFF | OFF |
| | 15% | OFF | OFF | OFF | OFF | ON | OFF | OFF | ON | OFF | OFF | OFF | OFF | OFF | OFF | OFF | ON | OFF | OFF | OFF | OFF |
| | 20% | OFF | OFF | OFF | OFF | ON | OFF | OFF | ON | OFF | OFF | OFF | OFF | ON | OFF | OFF | ON | OFF | OFF | OFF | OFF |
| | 25% | OFF | OFF | OFF | OFF | ON | OFF | OFF | ON | OFF | OFF | OFF | OFF | ON | OFF | OFF | OFF | ON | OFF | OFF | ON |
| | 30% | OFF | OFF | OFF | OFF | ON | OFF | OFF | ON | OFF | ON | OFF | OFF | OFF | OFF | ON | OFF | ON | OFF | OFF | ON |
| | 35% | OFF | OFF | OFF | OFF | ON | OFF | OFF | ON | OFF | ON | OFF | OFF | ON | OFF | ON | OFF | ON | OFF | OFF | ON |
| | 40% | OFF | OFF | OFF | OFF | ON | ON | OFF | ON | OFF | OFF | ON | OFF | OFF | ON | OFF | OFF | ON | OFF | ON | ON |
| | 45% | OFF | OFF | OFF | OFF | ON | ON | OFF | ON | OFF | OFF | ON | OFF | OFF | ON | ON | OFF | ON | OFF | ON | ON |
| | 50% | OFF | OFF | OFF | OFF | ON | ON | OFF | ON | ON | OFF | ON | ON | OFF | ON | ON | OFF | OFF | ON | ON | OFF |
| | 55% | OFF | ON | OFF | OFF | ON | ON | OFF | ON | ON | OFF | ON | ON | OFF | ON | ON | OFF | OFF | ON | ON | OFF |
| | 60% | ON | OFF | OFF | ON | ON | ON | OFF | ON | ON | OFF | ON | ON | OFF | ON | ON | OFF | OFF | ON | ON | OFF |
| | 65% | ON | ON | OFF | ON | ON | ON | OFF | ON | ON | OFF | ON | ON | OFF | ON | ON | OFF | OFF | ON | ON | OFF |
| | 70% | ON | OFF | OFF | ON | ON | ON | ON | OFF | OFF | ON | ON | ON | ON | OFF | OFF | ON | ON | ON | ON | ON |
| | 75% | ON | ON | OFF | ON | ON | ON | ON | OFF | OFF | ON | ON | ON | ON | OFF | OFF | ON | ON | ON | ON | ON |
| | 80% | ON | OFF | OFF | ON | ON | ON | ON | ON | OFF | ON | ON | ON | ON | ON | ON | OFF | ON | ON | ON | ON |
| | 85% | ON | ON | OFF | ON | ON | ON | ON | ON | OFF | ON | ON | ON | ON | ON | ON | OFF | ON | ON | ON | ON |
| | 90% | ON | OFF | OFF | ON | ON | ON | ON | ON | ON | ON | ON | ON | ON | ON | ON | ON | ON | ON | ON | ON |
| | 95% | ON | ON | OFF | ON | ON | ON | ON | ON | ON | ON | ON | ON | ON | ON | ON | ON | ON | ON | ON | ON |
| | 100% | ON | ON | ON | ON | ON | ON | ON | ON | ON | ON | ON | ON | ON | ON | ON | ON | ON | ON | ON | ON |

FIG. 10C

| Ts-Tt (msec) | Rt \ wn | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|---|
| -30≤Ts−Tt<30 | 0% | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | OFF | OFF | OFF | OFF | OFF | ON | OFF | OFF | OFF | OFF | OFF | OFF | OFF | OFF | OFF | OFF |
| | 10% | OFF | OFF | OFF | OFF | ON | OFF | OFF | OFF | OFF | OFF | OFF | OFF | OFF | ON | OFF | OFF | OFF | OFF | OFF | OFF |
| | 15% | OFF | OFF | OFF | ON | OFF | OFF | OFF | OFF | OFF | OFF | ON | OFF | OFF | OFF | OFF | OFF | OFF | ON | OFF | OFF |
| | 20% | OFF | OFF | ON | OFF | OFF | OFF | OFF | ON | OFF | OFF | OFF | OFF | ON | OFF | OFF | OFF | OFF | ON | OFF | OFF |
| | 25% | OFF | OFF | ON | OFF | OFF | ON | OFF | OFF | OFF | OFF | ON | OFF | OFF | ON | OFF | OFF | OFF | OFF | ON | OFF |
| | 30% | OFF | OFF | ON | OFF | OFF | ON | OFF | OFF | ON | OFF | OFF | ON | OFF | OFF | ON | OFF | OFF | ON | OFF | OFF |
| | 35% | OFF | ON | OFF | OFF | ON | OFF | OFF | ON | OFF | OFF | ON | OFF | OFF | ON | OFF | OFF | ON | OFF | OFF | ON |
| | 40% | ON | OFF | OFF | ON | OFF | OFF | ON | OFF | OFF | ON | ON | OFF | OFF | ON | OFF | OFF | ON | OFF | OFF | ON |
| | 45% | ON | OFF | OFF | ON | ON | OFF | OFF | ON | ON | OFF | OFF | ON | OFF | OFF | ON | ON | OFF | OFF | ON | OFF |
| | 50% | OFF | ON | ON | OFF | OFF | ON | ON | OFF | OFF | ON | ON | OFF | OFF | ON | ON | OFF | OFF | ON | ON | OFF |
| | 55% | OFF | ON | ON | OFF | OFF | ON | ON | OFF | OFF | ON | ON | OFF | ON | ON | OFF | OFF | ON | ON | OFF | ON |
| | 60% | OFF | ON | ON | OFF | ON | ON | OFF | ON | ON | OFF | OFF | ON | ON | OFF | ON | ON | OFF | ON | ON | OFF |
| | 65% | ON | OFF | ON | ON | OFF | ON | ON | OFF | ON | ON | OFF | ON | ON | OFF | ON | ON | OFF | ON | ON | OFF |
| | 70% | ON | ON | OFF | ON | ON | OFF | ON | ON | OFF | ON | ON | OFF | ON | ON | OFF | ON | ON | OFF | ON | ON |
| | 75% | ON | ON | OFF | ON | ON | OFF | ON | ON | ON | ON | OFF | ON | ON | OFF | ON | ON | ON | ON | OFF | ON |
| | 80% | ON | ON | OFF | ON | ON | ON | ON | OFF | ON | ON | ON | ON | OFF | ON | ON | ON | ON | OFF | ON | ON |
| | 85% | ON | ON | ON | OFF | ON | ON | ON | ON | ON | ON | OFF | ON | ON | ON | ON | ON | ON | OFF | ON | ON |
| | 90% | ON | ON | ON | ON | OFF | ON | ON | ON | ON | ON | ON | ON | ON | OFF | ON | ON | ON | ON | ON | ON |
| | 95% | ON | ON | ON | ON | ON | ON | ON | ON | ON | OFF | ON | ON | ON | ON | ON | ON | ON | ON | ON | ON |
| | 100% | ON | ON | ON | ON | ON | ON | ON | ON | ON | ON | ON | ON | ON | ON | ON | ON | ON | ON | ON | ON |

FIG. 10D

| Ts-Tt (msec) | Rt \ wn | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|---|
| -70≤Ts−Tt<-30 | 0% | OFF | OFF | OFF | OFF | OFF | OFF | OFF | OFF | OFF | OFF | OFF | OFF | OFF | OFF | OFF | OFF | OFF | OFF | OFF | OFF |
| | 5% | ON | OFF | OFF | OFF | OFF | OFF | OFF | OFF | OFF | OFF | OFF | OFF | OFF | OFF | OFF | OFF | OFF | OFF | OFF | OFF |
| | 10% | ON | OFF | OFF | OFF | OFF | OFF | OFF | OFF | OFF | ON | OFF | OFF | OFF | OFF | OFF | OFF | OFF | OFF | OFF | OFF |
| | 15% | ON | OFF | OFF | ON | OFF | OFF | OFF | OFF | OFF | ON | OFF | OFF | OFF | OFF | OFF | OFF | OFF | OFF | OFF | OFF |
| | 20% | ON | OFF | OFF | ON | OFF | OFF | ON | OFF | OFF | ON | OFF | OFF | OFF | OFF | OFF | OFF | OFF | OFF | OFF | OFF |
| | 25% | ON | OFF | OFF | ON | OFF | OFF | ON | OFF | OFF | ON | OFF | OFF | OFF | OFF | ON | OFF | OFF | OFF | OFF | OFF |
| | 30% | ON | OFF | OFF | ON | OFF | ON | OFF | OFF | OFF | OFF | ON | OFF | ON | OFF | OFF | ON | OFF | OFF | OFF | OFF |
| | 35% | ON | OFF | OFF | ON | OFF | ON | OFF | OFF | ON | OFF | ON | OFF | ON | OFF | OFF | ON | OFF | OFF | OFF | OFF |
| | 40% | ON | ON | OFF | ON | OFF | OFF | ON | OFF | OFF | ON | OFF | OFF | ON | OFF | ON | ON | OFF | OFF | OFF | OFF |
| | 45% | ON | ON | OFF | ON | OFF | OFF | ON | OFF | OFF | ON | ON | OFF | ON | OFF | ON | ON | OFF | OFF | OFF | OFF |
| | 50% | ON | ON | OFF | ON | ON | OFF | ON | ON | OFF | ON | ON | OFF | OFF | ON | ON | OFF | OFF | OFF | OFF | OFF |
| | 55% | ON | ON | OFF | ON | ON | OFF | ON | ON | OFF | ON | ON | OFF | OFF | ON | ON | OFF | OFF | ON | OFF | OFF |
| | 60% | ON | ON | OFF | ON | ON | OFF | ON | ON | OFF | ON | ON | OFF | OFF | ON | ON | OFF | ON | OFF | OFF | ON |
| | 65% | ON | ON | OFF | ON | ON | OFF | ON | ON | OFF | ON | ON | OFF | OFF | ON | ON | OFF | ON | ON | OFF | ON |
| | 70% | ON | ON | ON | OFF | ON | ON | ON | ON | OFF | ON | OFF | ON | ON | OFF | ON | ON | ON | OFF | OFF | ON |
| | 75% | ON | ON | ON | OFF | ON | ON | ON | ON | OFF | ON | OFF | ON | ON | OFF | ON | ON | ON | ON | OFF | ON |
| | 80% | ON | ON | ON | ON | OFF | ON | ON | ON | ON | ON | ON | OFF | ON | ON | ON | ON | ON | OFF | OFF | ON |
| | 85% | ON | ON | ON | ON | OFF | ON | ON | ON | ON | ON | ON | OFF | ON | ON | ON | ON | ON | ON | OFF | ON |
| | 90% | ON | ON | ON | ON | ON | ON | ON | ON | ON | ON | ON | ON | ON | ON | ON | ON | ON | OFF | OFF | ON |
| | 95% | ON | ON | ON | ON | ON | ON | ON | ON | ON | ON | ON | ON | ON | ON | ON | ON | ON | ON | OFF | ON |
| | 100% | ON | ON | ON | ON | ON | ON | ON | ON | ON | ON | ON | ON | ON | ON | ON | ON | ON | ON | ON | ON |

FIG. 10E

| Ts-Tt (msec) | Rt \ wn | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|---|
| -100≤Ts−Tt<-70 | 0% | OFF | OFF | OFF | OFF | OFF | OFF | OFF | OFF | OFF | OFF | OFF | OFF | OFF | OFF | OFF | OFF | OFF | OFF | OFF | OFF |
| | 5% | ON | OFF | OFF | OFF | OFF | OFF | OFF | OFF | OFF | OFF | OFF | OFF | OFF | OFF | OFF | OFF | OFF | OFF | OFF | OFF |
| | 10% | ON | ON | OFF | OFF | OFF | OFF | OFF | OFF | OFF | OFF | OFF | OFF | OFF | OFF | OFF | OFF | OFF | OFF | OFF | OFF |
| | 15% | ON | ON | OFF | OFF | ON | OFF | OFF | OFF | OFF | OFF | OFF | OFF | OFF | OFF | OFF | OFF | OFF | OFF | OFF | OFF |
| | 20% | ON | ON | OFF | ON | ON | OFF | OFF | OFF | OFF | OFF | OFF | OFF | OFF | OFF | OFF | OFF | OFF | OFF | OFF | OFF |
| | 25% | ON | ON | OFF | ON | ON | OFF | ON | OFF | OFF | OFF | OFF | OFF | OFF | OFF | OFF | OFF | OFF | OFF | OFF | OFF |
| | 30% | ON | ON | OFF | ON | ON | OFF | ON | ON | OFF | OFF | OFF | OFF | OFF | OFF | OFF | OFF | OFF | OFF | OFF | OFF |
| | 35% | ON | ON | OFF | ON | ON | OFF | ON | ON | OFF | OFF | OFF | OFF | OFF | OFF | OFF | OFF | OFF | ON | OFF | OFF |
| | 40% | ON | ON | OFF | ON | ON | OFF | ON | ON | OFF | OFF | ON | OFF | OFF | ON | OFF | OFF | OFF | OFF | OFF | OFF |
| | 45% | ON | ON | OFF | ON | ON | OFF | ON | ON | OFF | OFF | ON | OFF | OFF | ON | OFF | OFF | OFF | ON | OFF | OFF |
| | 50% | ON | ON | OFF | ON | ON | OFF | ON | ON | ON | OFF | OFF | ON | OFF | OFF | ON | OFF | OFF | ON | OFF | OFF |
| | 55% | ON | ON | OFF | ON | ON | ON | OFF | ON | ON | OFF | OFF | ON | OFF | OFF | ON | OFF | OFF | ON | ON | OFF |
| | 60% | ON | ON | ON | ON | ON | ON | OFF | ON | ON | OFF | OFF | ON | OFF | OFF | ON | OFF | OFF | ON | ON | OFF |
| | 65% | ON | ON | ON | ON | ON | ON | OFF | ON | ON | OFF | ON | ON | OFF | OFF | ON | OFF | OFF | ON | ON | OFF |
| | 70% | ON | ON | ON | ON | ON | ON | OFF | ON | ON | OFF | ON | ON | OFF | OFF | ON | ON | OFF | ON | ON | OFF |
| | 75% | ON | ON | ON | ON | ON | ON | OFF | ON | ON | OFF | ON | ON | OFF | OFF | ON | ON | OFF | ON | ON | ON |
| | 80% | OFF | ON | ON | ON | ON | OFF | ON | ON | ON | ON | OFF | ON | ON | ON | ON | OFF | ON | ON | ON | ON |
| | 85% | ON | ON | ON | ON | ON | OFF | ON | ON | ON | ON | OFF | ON | ON | ON | ON | OFF | ON | ON | ON | ON |
| | 90% | ON | ON | ON | ON | ON | ON | ON | ON | ON | ON | OFF | ON | ON | ON | ON | OFF | ON | ON | ON | ON |
| | 95% | ON | ON | ON | ON | ON | ON | ON | ON | ON | ON | ON | ON | OFF | ON | ON | ON | ON | ON | ON | ON |
| | 100% | ON | ON | ON | ON | ON | ON | ON | ON | ON | ON | ON | ON | ON | ON | ON | ON | ON | ON | ON | ON |

FIG. 13

| BASIS WEIGHT ($g/m^2$) | PAPER MODE | DEVIATION AMOUNT Ts−Tt (msec) | POWER SUPPLY RATE ADDITION VALUE Et(%) | CORRECTION PERIOD EXTENSION |
|---|---|---|---|---|
| 60~70 | THIN PAPER MODE | 130≤Ts−Tt<170 | 0% | YES |
| | | 100≤Ts−Tt<130 | 0% | YES |
| | | 70≤Ts−Tt<100 | 0% | YES |
| | | 30≤Ts−Tt<70 | +5% | YES |
| | | -30≤Ts−Tt<30 | +5% | NO |
| 71~90 | NORMAL MODE | 130≤Ts−Tt<170 | +5% | YES |
| | | 100≤Ts−Tt<130 | +5% | YES |
| | | 70≤Ts−Tt<100 | +5% | YES |
| | | 30≤Ts−Tt<70 | +5% | YES |
| | | -30≤Ts−Tt<30 | +10% | NO |
| 91~128 | THICK PAPER MODE 1 | 130≤Ts−Tt<170 | +15% | YES |
| | | 100≤Ts−Tt<130 | +15% | YES |
| | | 70≤Ts−Tt<100 | +15% | YES |
| | | 30≤Ts−Tt<70 | +15% | YES |
| | | -30≤Ts−Tt<30 | +25% | NO |
| 129~220 | THICK PAPER MODE 2 | 130≤Ts−Tt<170 | +20% | YES |
| | | 100≤Ts−Tt<130 | +20% | YES |
| | | 70≤Ts−Tt<100 | +20% | YES |
| | | 30≤Ts−Tt<70 | +20% | YES |
| | | -30≤Ts−Tt<30 | +35% | NO |

FIG. 14A

| Ts-Tt (msec) | | 1ST CYCLE IN CONTROL | | | | | | | | | | | | | | | | | | | | 2ND CYCLE IN CONTROL | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| | Rt \ wn | 1 | 2 | 3 | 4 | 5 | 6 | 7 | 8 | 9 | 10 | 11 | 12 | 13 | 14 | 15 | 16 | 17 | 18 | 19 | 20 | 1 | 2 | 3 | 4 | 5 | 6 | 7 | 8 | 9 | 10 | 11 | 12 | 13 | 14 | 15 | 16 | 17 | 18 | 19 | 20 |
| 130≤Ts−Tt<170 | 0% | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | OFF | OFF | OFF | OFF | OFF | OFF | OFF | OFF | OFF | OFF | ON | OFF | OFF | OFF | OFF | OFF | OFF | OFF | OFF | OFF | OFF | ON | OFF | OFF | OFF | OFF | OFF | OFF | OFF | OFF | OFF | OFF | OFF | OFF | OFF | OFF |
| | 10% | OFF | OFF | OFF | OFF | OFF | OFF | OFF | OFF | OFF | OFF | OFF | OFF | OFF | OFF | ON | OFF | OFF | OFF | OFF | ON | OFF | OFF | ON | OFF | OFF | OFF | OFF | ON | OFF | OFF | OFF | OFF | OFF | OFF | OFF | OFF | OFF | OFF | OFF | OFF |
| | 15% | OFF | OFF | OFF | OFF | OFF | OFF | OFF | OFF | OFF | OFF | OFF | OFF | OFF | OFF | ON | OFF | OFF | ON | OFF | ON | OFF | OFF | OFF | OFF | ON | OFF | ON | OFF | OFF | ON | OFF | OFF | OFF | OFF | OFF | OFF | OFF | OFF | OFF | OFF |
| | 20% | OFF | OFF | OFF | OFF | OFF | OFF | OFF | OFF | OFF | OFF | OFF | OFF | OFF | OFF | ON | OFF | OFF | ON | ON | OFF | OFF | ON | OFF | OFF | ON | OFF | OFF | ON | ON | OFF | OFF | ON | OFF | OFF | OFF | OFF | OFF | OFF | OFF | OFF |
| | 25% | OFF | OFF | OFF | OFF | OFF | ON | OFF | OFF | OFF | OFF | OFF | OFF | OFF | OFF | ON | OFF | OFF | ON | ON | OFF | OFF | ON | OFF | OFF | ON | OFF | OFF | ON | ON | OFF | OFF | ON | OFF | OFF | OFF | OFF | ON | OFF | OFF | OFF |
| | 30% | OFF | OFF | OFF | OFF | OFF | ON | OFF | OFF | OFF | OFF | ON | OFF | OFF | OFF | ON | ON | OFF | ON | ON | OFF | ON | ON | OFF | OFF | ON | OFF | OFF | ON | ON | OFF | OFF | ON | OFF | OFF | OFF | OFF | OFF | OFF | OFF | OFF |
| | 35% | OFF | OFF | OFF | OFF | OFF | ON | OFF | OFF | OFF | OFF | ON | OFF | OFF | OFF | ON | ON | OFF | ON | ON | OFF | ON | ON | OFF | ON | ON | OFF | OFF | ON | ON | OFF | OFF | ON | OFF | OFF | OFF | OFF | ON | OFF | OFF | OFF |
| | 40% | OFF | OFF | OFF | OFF | OFF | ON | OFF | OFF | OFF | OFF | ON | OFF | OFF | OFF | ON | ON | OFF | ON | ON | OFF | ON | ON | OFF | ON | ON | OFF | OFF | ON | ON | OFF | OFF | ON | ON | OFF | OFF | OFF | ON | OFF | OFF | ON |
| | 45% | OFF | OFF | OFF | OFF | OFF | ON | OFF | OFF | OFF | OFF | ON | OFF | ON | OFF | ON | ON | OFF | ON | ON | OFF | ON | ON | OFF | ON | ON | OFF | OFF | ON | ON | ON | OFF | ON | ON | OFF | OFF | OFF | ON | OFF | OFF | ON |
| | 50% | OFF | ON | OFF | OFF | ON | OFF | OFF | ON | OFF | OFF | ON | OFF | OFF | ON | ON | ON | ON | OFF | ON | ON | ON | OFF | ON | ON | OFF | ON | ON | OFF | ON | ON | OFF | ON | OFF | OFF | OFF | ON | OFF | OFF | ON | OFF |
| | 55% | OFF | ON | OFF | OFF | ON | OFF | OFF | ON | OFF | OFF | ON | OFF | ON | ON | ON | ON | OFF | OFF | ON | ON | ON | ON | ON | OFF | ON | ON | ON | ON | OFF | ON | OFF | ON | ON | OFF | OFF | ON | OFF | OFF | ON | OFF |
| | 60% | ON | OFF | OFF | ON | ON | OFF | ON | OFF | OFF | ON | OFF | ON | OFF | ON | ON | ON | ON | ON | ON | OFF | ON | ON | ON | ON | OFF | ON | ON | OFF | ON | ON | OFF | ON | ON | OFF | OFF | ON | OFF | OFF | ON | OFF |
| | 65% | ON | OFF | OFF | ON | ON | OFF | ON | OFF | OFF | ON | OFF | ON | OFF | ON | ON | ON | ON | ON | ON | OFF | ON | ON | ON | ON | OFF | ON | ON | ON | ON | ON | ON | OFF | ON | OFF | ON | OFF | OFF | ON | OFF | ON |
| | 70% | ON | OFF | OFF | ON | ON | OFF | ON | ON | OFF | ON | ON | OFF | ON | ON | ON | ON | ON | ON | OFF | ON | ON | ON | ON | OFF | ON | ON | ON | ON | OFF | ON | ON | ON | OFF | ON | ON | OFF | ON | OFF | OFF | ON |
| | 75% | ON | OFF | OFF | ON | ON | OFF | ON | ON | ON | ON | OFF | ON | ON | ON | ON | ON | ON | OFF | ON | ON | ON | ON | OFF | ON | ON | ON | ON | OFF | ON | ON | ON | ON | OFF | ON | ON | ON | ON | OFF | OFF | ON |
| | 80% | ON | OFF | OFF | ON | ON | OFF | ON | ON | OFF | ON | ON | OFF | ON | ON | ON | ON | ON | ON | ON | ON | OFF | ON | ON | ON | ON | ON | ON | ON | ON | ON | ON | ON | OFF | ON | ON | ON | ON | ON | ON | OFF |
| | 85% | ON | OFF | OFF | ON | ON | ON | ON | ON | OFF | ON | ON | OFF | ON | ON | ON | ON | ON | ON | ON | ON | ON | ON | ON | ON | ON | ON | ON | ON | ON | ON | ON | ON | OFF | ON | ON | OFF | ON | ON | ON | ON |
| | 90% | ON | OFF | ON | ON | OFF | ON | ON | OFF | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | OFF | ON |
| | 95% | ON | ON | ON | ON | ON | ON | ON | OFF | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | OFF | ON |
| | 100% | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON |

FIG. 14B

| Ts-Tt (msec) | 1ST CYCLE IN CONTROL | | | | | | | | | | | | | | | | | | | | | 2ND CYCLE IN CONTROL | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | Rt \ wn | 1 | 2 | 3 | 4 | 5 | 6 | 7 | 8 | 9 | 10 | 11 | 12 | 13 | 14 | 15 | 16 | 17 | 18 | 19 | 20 | 1 | 2 | 3 | 4 | 5 | 6 | 7 | 8 | 9 | 10 | 11 | 12 | 13 | 14 | 15 | 16 | 17 | 18 | 19 | 20 |
| 100≤Ts-Tt<130 | 0% | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | OFF | OFF | OFF | OFF | OFF | OFF | OFF | ON | OFF | OFF | OFF | OFF | OFF | OFF | OFF | OFF | OFF | OFF | ON | OFF | OFF | OFF | OFF | OFF | OFF | OFF | OFF | OFF | OFF | OFF | OFF | OFF | OFF | OFF | OFF | OFF |
| | 10% | OFF | OFF | OFF | OFF | OFF | OFF | OFF | OFF | OFF | OFF | OFF | ON | OFF | OFF | OFF | OFF | ON | OFF | OFF | ON | OFF | OFF | OFF | OFF | ON | OFF | OFF | OFF | OFF | OFF | OFF | OFF | OFF | OFF | OFF | OFF | OFF | OFF | OFF | OFF |
| | 15% | OFF | OFF | OFF | OFF | OFF | OFF | OFF | OFF | OFF | OFF | OFF | ON | OFF | OFF | ON | OFF | ON | OFF | OFF | OFF | OFF | ON | OFF | ON | OFF | OFF | ON | OFF | OFF | OFF | OFF | OFF | OFF | OFF | OFF | OFF | OFF | OFF | OFF | OFF |
| | 20% | OFF | OFF | OFF | OFF | OFF | OFF | OFF | OFF | OFF | OFF | OFF | ON | OFF | OFF | ON | ON | OFF | OFF | ON | OFF | OFF | ON | OFF | OFF | ON | ON | OFF | OFF | ON | OFF | OFF | OFF | OFF | OFF | OFF | OFF | OFF | OFF | OFF | OFF |
| | 25% | OFF | OFF | OFF | ON | OFF | OFF | OFF | OFF | OFF | OFF | ON | OFF | OFF | OFF | ON | ON | OFF | OFF | ON | OFF | OFF | ON | OFF | OFF | ON | ON | OFF | OFF | ON | OFF | OFF | OFF | OFF | ON | OFF | OFF | OFF | OFF | OFF | OFF |
| | 30% | OFF | OFF | ON | OFF | OFF | OFF | OFF | ON | OFF | OFF | OFF | ON | ON | OFF | ON | ON | OFF | ON | ON | OFF | OFF | ON | OFF | OFF | ON | ON | OFF | OFF | ON | OFF | OFF | OFF | OFF | OFF | OFF | OFF | OFF | OFF | OFF | OFF |
| | 35% | OFF | OFF | ON | OFF | OFF | OFF | OFF | ON | OFF | OFF | OFF | ON | ON | OFF | ON | ON | OFF | ON | ON | OFF | ON | ON | OFF | OFF | ON | ON | OFF | OFF | ON | OFF | OFF | OFF | OFF | ON | OFF | OFF | OFF | OFF | OFF | OFF |
| | 40% | OFF | OFF | ON | OFF | OFF | OFF | OFF | ON | OFF | OFF | OFF | ON | ON | OFF | ON | ON | OFF | ON | ON | OFF | ON | ON | OFF | OFF | ON | ON | OFF | OFF | ON | ON | OFF | OFF | OFF | ON | OFF | OFF | ON | OFF | OFF | OFF |
| | 45% | OFF | OFF | ON | OFF | OFF | OFF | OFF | ON | OFF | ON | OFF | ON | ON | OFF | ON | OFF | ON | OFF | ON | ON | ON | ON | OFF | ON | OFF | ON | ON | OFF | ON | ON | OFF | OFF | OFF | ON | OFF | OFF | ON | OFF | OFF | OFF |
| | 50% | OFF | ON | OFF | OFF | OFF | OFF | ON | OFF | ON | OFF | OFF | ON | ON | OFF | ON | ON | OFF | ON | ON | ON | ON | OFF | ON | ON | OFF | ON | ON | OFF | ON | ON | OFF | ON | OFF | OFF | ON | OFF | OFF | ON | OFF | OFF |
| | 55% | OFF | ON | OFF | ON | OFF | ON | OFF | OFF | ON | OFF | ON | OFF | ON | OFF | ON | ON | ON | ON | ON | ON | ON | OFF | ON | ON | OFF | ON | ON | OFF | ON | OFF | OFF | ON | OFF | ON | OFF | ON | OFF | OFF | ON | OFF |
| | 60% | OFF | ON | OFF | OFF | ON | ON | OFF | OFF | ON | OFF | ON | ON | ON | ON | ON | ON | OFF | ON | ON | ON | ON | OFF | ON | ON | OFF | ON | ON | OFF | ON | ON | OFF | OFF | ON | ON | OFF | OFF | ON | ON | OFF | OFF |
| | 65% | OFF | ON | OFF | ON | OFF | OFF | ON | OFF | ON | OFF | ON | ON | ON | ON | ON | ON | ON | ON | OFF | ON | ON | ON | ON | ON | ON | OFF | ON | OFF | ON | ON | OFF | ON | ON | ON | OFF | OFF | ON | ON | OFF | OFF |
| | 70% | ON | OFF | ON | OFF | OFF | ON | OFF | ON | OFF | ON | ON | ON | ON | ON | ON | OFF | ON | ON | ON | ON | ON | OFF | ON | ON | ON | ON | OFF | ON | ON | OFF | ON | ON | OFF | ON | ON | OFF | ON | ON | OFF | ON |
| | 75% | ON | OFF | ON | OFF | OFF | ON | OFF | ON | OFF | ON | ON | ON | ON | ON | ON | OFF | ON | ON | ON | ON | ON | OFF | ON | ON | ON | ON | ON | ON | OFF | ON | ON | ON | ON | ON | ON | OFF | ON | ON | OFF | ON |
| | 80% | ON | ON | OFF | ON | ON | OFF | ON | ON | OFF | ON | ON | ON | ON | ON | ON | ON | ON | ON | ON | ON | ON | ON | ON | ON | ON | ON | ON | ON | ON | OFF | ON | ON | OFF | ON | ON | OFF | ON | ON | OFF | OFF |
| | 85% | ON | ON | OFF | ON | ON | OFF | ON | ON | ON | ON | ON | ON | ON | ON | ON | ON | ON | ON | ON | ON | ON | ON | ON | ON | ON | ON | ON | ON | ON | OFF | ON | ON | OFF | ON | ON | OFF | ON | ON | OFF | ON |
| | 90% | ON | OFF | ON | ON | OFF | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | OFF | ON | ON | OFF | ON |
| | 95% | ON | ON | ON | ON | OFF | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | OFF | ON | ON | ON | ON |
| | 100% | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON |

FIG. 14C

| Ts-Tt (msec) | | 1ST CYCLE IN CONTROL | | | | | | | | | | | | | | | | | | | | 2ND CYCLE IN CONTROL | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | Rt \ wn | 1 | 2 | 3 | 4 | 5 | 6 | 7 | 8 | 9 | 10 | 11 | 12 | 13 | 14 | 15 | 16 | 17 | 18 | 19 | 20 | 1 | 2 | 3 | 4 | 5 | 6 | 7 | 8 | 9 | 10 | 11 | 12 | 13 | 14 | 15 | 16 | 17 | 18 | 19 | 20 |
| 70≤Ts-Tt<100 | 0% | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | OFF | OFF | OFF | OFF | ON | OFF | OFF | OFF | OFF | OFF | OFF | OFF | OFF | OFF | OFF | ON | OFF | OFF | OFF | OFF | OFF | OFF | OFF | OFF | OFF | OFF | OFF | OFF | OFF | OFF | OFF | OFF | OFF | OFF | OFF | OFF |
| | 10% | OFF | OFF | OFF | OFF | OFF | OFF | OFF | OFF | ON | OFF | OFF | OFF | OFF | OFF | OFF | ON | OFF | OFF | OFF | OFF | OFF | ON | OFF | OFF | OFF | OFF | ON | OFF | OFF | OFF | OFF | OFF | OFF | OFF | OFF | OFF | OFF | OFF | OFF | OFF |
| | 15% | OFF | OFF | OFF | OFF | OFF | OFF | OFF | OFF | ON | OFF | OFF | OFF | OFF | ON | OFF | OFF | ON | OFF | OFF | OFF | OFF | ON | OFF | OFF | OFF | OFF | ON | OFF | OFF | OFF | OFF | OFF | OFF | OFF | OFF | ON | OFF | OFF | OFF | OFF |
| | 20% | OFF | OFF | OFF | OFF | OFF | OFF | OFF | OFF | ON | OFF | OFF | ON | OFF | ON | OFF | OFF | OFF | OFF | ON | OFF | OFF | ON | ON | OFF | OFF | OFF | ON | OFF | OFF | ON | OFF | OFF | OFF | OFF | OFF | OFF | OFF | OFF | OFF | OFF |
| | 25% | OFF | OFF | OFF | OFF | OFF | OFF | OFF | OFF | ON | OFF | OFF | ON | OFF | ON | OFF | OFF | ON | OFF | ON | OFF | OFF | ON | OFF | ON | OFF | OFF | ON | OFF | OFF | ON | OFF | OFF | OFF | OFF | OFF | OFF | OFF | OFF | ON | OFF |
| | 30% | ON | OFF | OFF | OFF | OFF | OFF | OFF | ON | OFF | OFF | ON | ON | OFF | OFF | ON | ON | OFF | OFF | ON | OFF | OFF | ON | OFF | OFF | ON | OFF | OFF | ON | OFF | OFF | ON | OFF | OFF | OFF | OFF | OFF | OFF | ON | OFF | OFF |
| | 35% | ON | OFF | OFF | OFF | OFF | ON | OFF | OFF | ON | OFF | OFF | ON | ON | OFF | OFF | ON | OFF | ON | ON | OFF | ON | OFF | OFF | ON | OFF | OFF | ON | OFF | OFF | ON | OFF | OFF | ON | OFF | OFF | OFF | OFF | ON | OFF | OFF |
| | 40% | OFF | ON | OFF | OFF | OFF | OFF | ON | OFF | ON | OFF | OFF | ON | ON | OFF | ON | ON | OFF | ON | ON | OFF | ON | ON | OFF | ON | OFF | OFF | ON | OFF | OFF | ON | OFF | OFF | ON | OFF | OFF | ON | OFF | OFF | ON | OFF |
| | 45% | ON | OFF | OFF | OFF | OFF | ON | OFF | ON | ON | OFF | OFF | ON | ON | OFF | ON | OFF | ON | ON | OFF | ON | ON | OFF | OFF | ON | ON | OFF | ON | OFF | OFF | ON | OFF | ON | OFF | OFF | OFF | ON | OFF | OFF | ON | OFF |
| | 50% | ON | OFF | OFF | OFF | OFF | ON | ON | OFF | ON | ON | OFF | ON | ON | OFF | ON | ON | OFF | ON | ON | OFF | ON | ON | OFF | ON | ON | OFF | ON | OFF | OFF | ON | OFF | ON | OFF | OFF | OFF | ON | OFF | OFF | ON | OFF |
| | 55% | ON | OFF | OFF | OFF | OFF | ON | ON | OFF | ON | ON | OFF | ON | ON | OFF | ON | ON | OFF | ON | ON | OFF | ON | ON | OFF | ON | ON | OFF | ON | OFF | ON | OFF | ON | OFF | ON | OFF | ON | OFF | ON | OFF | ON | OFF |
| | 60% | ON | OFF | OFF | OFF | OFF | ON | OFF | ON | ON | ON | OFF | ON | ON | OFF | ON | ON | ON | OFF | ON | ON | ON | OFF | ON | ON | OFF | ON | ON | OFF | ON | ON | OFF | ON | OFF | OFF | ON | OFF | ON | ON | OFF | ON |
| | 65% | ON | OFF | ON | ON | OFF | ON | ON | OFF | ON | ON | ON | ON | OFF | ON | ON | ON | ON | ON | ON | OFF | ON | OFF | OFF | ON | OFF | ON | ON | OFF | ON | ON | OFF | ON | OFF | ON | ON | OFF | ON | OFF | OFF | ON |
| | 70% | ON | OFF | OFF | ON | OFF | ON | ON | OFF | ON | ON | ON | ON | ON | OFF | ON | ON | ON | ON | OFF | ON | ON | ON | ON | ON | OFF | ON | ON | OFF | ON | ON | ON | OFF | OFF | ON | ON | ON | ON | OFF | OFF | ON |
| | 75% | ON | OFF | ON | ON | OFF | ON | ON | OFF | ON | ON | ON | ON | OFF | ON | ON | ON | ON | ON | OFF | ON | ON | ON | ON | OFF | ON | ON | ON | OFF | ON | ON | ON | ON | OFF | ON | ON | ON | OFF | ON | ON | OFF |
| | 80% | ON | OFF | ON | ON | OFF | ON | ON | OFF | ON | ON | ON | ON | ON | ON | ON | ON | ON | ON | ON | ON | ON | ON | ON | ON | OFF | ON | ON | ON | ON | OFF | ON | ON | OFF | ON | ON | OFF | ON | ON | OFF | ON |
| | 85% | ON | OFF | ON | ON | OFF | ON | ON | OFF | ON | ON | ON | ON | ON | ON | ON | ON | ON | ON | ON | ON | ON | ON | ON | ON | ON | ON | ON | ON | OFF | ON | ON | ON | OFF | ON | ON | ON | ON | OFF | ON | ON |
| | 90% | ON | ON | ON | ON | ON | OFF | OFF | ON | ON | ON | ON | ON | ON | ON | ON | ON | ON | ON | ON | ON | ON | ON | ON | ON | ON | ON | ON | ON | ON | ON | ON | ON | OFF | ON | ON | ON | ON | ON | ON | OFF |
| | 95% | ON | ON | ON | ON | ON | ON | OFF | ON | ON | ON | ON | ON | ON | ON | ON | ON | ON | ON | ON | ON | ON | ON | ON | ON | ON | ON | ON | ON | ON | ON | ON | OFF | ON | ON | ON | ON | ON | ON | ON | ON |
| | 100% | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON |

FIG. 14D

| Ts-Tt (msec) | Rt \ wn | 1ST CYCLE IN CONTROL | | | | | | | | | | | | | | | | | | | | 2ND CYCLE IN CONTROL | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 | 19 | 20 | 1 | 2 | 3 | 4 | 5 | 6 | 7 | 8 | 9 | 10 | 11 | 12 | 13 | 14 | 15 | 16 | 17 | 18 | 19 | 20 |
| 30≤Ts-Tt<70 | 0% | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | ON | OFF | OFF | OFF | OFF | OFF | OFF | OFF | OFF | OFF | OFF | ON | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF | OFF |
| | 10% | OFF | OFF | OFF | OFF | ON | OFF | OFF | OFF | OFF | OFF | OFF | ON | OFF | OFF | OFF | OFF | OFF | ON | OFF | OFF | OFF | OFF | ON | OFF | OFF | OFF | OFF | OFF | OFF | OFF | OFF | OFF | OFF | OFF | OFF | OFF | OFF | OFF | OFF | OFF |
| | 15% | OFF | OFF | OFF | OFF | ON | OFF | OFF | OFF | OFF | ON | OFF | OFF | ON | OFF | OFF | OFF | OFF | ON | OFF | OFF | OFF | OFF | ON | OFF | OFF | OFF | OFF | OFF | OFF | OFF | OFF | ON | OFF | OFF | OFF | OFF | OFF | OFF | OFF | OFF |
| | 20% | OFF | OFF | OFF | OFF | ON | OFF | OFF | ON | OFF | ON | OFF | OFF | OFF | OFF | ON | OFF | OFF | ON | ON | OFF | OFF | OFF | ON | OFF | OFF | ON | OFF | OFF | OFF | OFF | OFF | OFF | OFF | OFF | OFF | OFF | OFF | OFF | OFF | OFF |
| | 25% | OFF | OFF | OFF | OFF | ON | OFF | OFF | ON | OFF | ON | OFF | OFF | ON | OFF | ON | OFF | OFF | ON | OFF | ON | OFF | OFF | ON | OFF | OFF | ON | OFF | OFF | OFF | OFF | OFF | OFF | OFF | OFF | ON | OFF | OFF | OFF | OFF | OFF |
| | 30% | OFF | OFF | OFF | OFF | ON | OFF | OFF | ON | ON | OFF | OFF | ON | OFF | ON | ON | OFF | ON | OFF | OFF | ON | OFF | ON | OFF | OFF | OFF | OFF | ON | OFF | OFF | OFF | OFF | OFF | OFF | ON | OFF | OFF | ON | OFF | OFF | OFF |
| | 35% | OFF | ON | OFF | OFF | ON | OFF | OFF | ON | ON | OFF | OFF | ON | OFF | ON | ON | OFF | ON | OFF | OFF | ON | OFF | ON | OFF | OFF | OFF | OFF | ON | OFF | ON | OFF | OFF | OFF | OFF | ON | OFF | OFF | ON | OFF | OFF | OFF |
| | 40% | OFF | OFF | OFF | ON | ON | OFF | OFF | ON | ON | OFF | ON | ON | OFF | ON | ON | OFF | ON | ON | OFF | OFF | OFF | ON | ON | OFF | OFF | ON | OFF | OFF | OFF | OFF | ON | OFF | OFF | OFF | ON | OFF | OFF | ON | OFF | OFF |
| | 45% | OFF | ON | OFF | ON | ON | OFF | OFF | ON | ON | OFF | ON | OFF | ON | ON | OFF | ON | ON | OFF | OFF | ON | ON | OFF | ON | OFF | OFF | ON | OFF | OFF | ON | OFF | OFF | ON | OFF | OFF | ON | OFF | OFF | ON | OFF | OFF |
| | 50% | OFF | ON | ON | OFF | ON | ON | OFF | ON | ON | OFF | ON | ON | OFF | ON | ON | OFF | ON | ON | OFF | ON | ON | OFF | ON | OFF | OFF | ON | OFF | OFF | ON | OFF | OFF | ON | OFF | OFF | ON | OFF | OFF | ON | OFF | OFF |
| | 55% | OFF | ON | ON | OFF | ON | ON | OFF | ON | ON | OFF | ON | ON | OFF | ON | ON | OFF | ON | ON | OFF | ON | ON | OFF | ON | OFF | ON | OFF | ON | ON | OFF | ON | OFF | ON | OFF | OFF | ON | OFF | OFF | ON | OFF | OFF |
| | 60% | OFF | ON | ON | OFF | ON | ON | OFF | ON | ON | OFF | ON | ON | ON | ON | OFF | ON | ON | OFF | ON | ON | OFF | ON | ON | OFF | ON | ON | OFF | OFF | ON | OFF | ON | OFF | ON | ON | OFF | ON | OFF | ON | OFF | OFF |
| | 65% | OFF | ON | ON | OFF | ON | ON | ON | ON | OFF | ON | ON | ON | ON | ON | ON | OFF | ON | OFF | OFF | ON | OFF | ON | ON | OFF | ON | ON | OFF | ON | OFF | ON | ON | OFF | ON | OFF | OFF | ON | ON | OFF | ON | ON |
| | 70% | OFF | ON | ON | OFF | ON | ON | ON | ON | ON | OFF | ON | ON | ON | ON | OFF | ON | ON | ON | ON | ON | OFF | ON | ON | OFF | ON | ON | ON | OFF | OFF | ON | ON | ON | ON | OFF | OFF | ON | ON | OFF | OFF | ON |
| | 75% | OFF | ON | ON | OFF | ON | ON | ON | ON | ON | OFF | ON | ON | ON | ON | OFF | ON | ON | ON | ON | ON | OFF | ON | ON | OFF | ON | ON | ON | OFF | ON | ON | ON | ON | OFF | ON | OFF | ON | ON | OFF | ON | ON |
| | 80% | OFF | ON | ON | OFF | ON | OFF | ON | ON | ON | ON | ON | ON | ON | ON | ON | ON | ON | ON | OFF | ON | ON | ON | ON | OFF | ON | ON | OFF | ON | ON | ON | ON | OFF | ON | ON | ON | ON | OFF | ON | ON | ON |
| | 85% | OFF | ON | ON | OFF | ON | ON | ON | ON | ON | ON | ON | ON | ON | ON | ON | ON | ON | ON | ON | ON | ON | ON | ON | ON | ON | OFF | ON | ON | OFF | ON | ON | ON | ON | ON | OFF | ON | ON | OFF | ON | ON |
| | 90% | ON | OFF | OFF | ON | ON | ON | ON | ON | ON | ON | ON | ON | ON | ON | ON | ON | ON | ON | ON | ON | ON | ON | ON | ON | ON | ON | ON | ON | OFF | ON | ON | ON | ON | ON | ON | OFF | ON | ON | ON | ON |
| | 95% | ON | ON | OFF | ON | ON | ON | ON | ON | ON | ON | ON | ON | ON | ON | ON | ON | ON | ON | ON | ON | ON | ON | ON | ON | ON | ON | ON | OFF | ON | ON | ON | ON | ON | ON | ON | ON | ON | ON | ON | ON |
| | 100% | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON | ON |

FIG. 14E

| Ts-Tt (msec) | 1ST CYCLE IN CONTROL | | | | | | | | | | | | | | | | | | | | |
|---|---|---|---|---|---|---|---|---|---|---|---|---|---|---|---|---|---|---|---|---|---|
| | Rt \ wn | 1 | 2 | 3 | 4 | 5 | 6 | 7 | 8 | 9 | 10 | 11 | 12 | 13 | 14 | 15 | 16 | 17 | 18 | 19 | 20 |
| -30≤Ts−Tt<30 | 0% | OFF | OFF | OFF | OFF | OFF | OFF | OFF | OFF | OFF | OFF | OFF | OFF | OFF | OFF | OFF | OFF | OFF | OFF | OFF | OFF |
| | 5% | OFF | OFF | OFF | OFF | OFF | OFF | OFF | OFF | OFF | ON | OFF | OFF | OFF | OFF | OFF | OFF | OFF | OFF | OFF | OFF |
| | 10% | OFF | OFF | OFF | OFF | ON | OFF | OFF | OFF | OFF | OFF | OFF | OFF | OFF | ON | OFF | OFF | OFF | OFF | OFF | OFF |
| | 15% | OFF | OFF | OFF | ON | OFF | OFF | OFF | OFF | OFF | OFF | ON | OFF | OFF | OFF | OFF | OFF | OFF | ON | OFF | OFF |
| | 20% | OFF | OFF | ON | OFF | OFF | OFF | OFF | ON | OFF | OFF | OFF | OFF | ON | OFF | OFF | OFF | OFF | ON | OFF | OFF |
| | 25% | OFF | OFF | ON | OFF | OFF | ON | OFF | OFF | OFF | OFF | ON | OFF | OFF | ON | OFF | OFF | OFF | OFF | ON | OFF |
| | 30% | OFF | OFF | ON | OFF | OFF | ON | OFF | OFF | ON | OFF | OFF | ON | OFF | OFF | ON | OFF | OFF | ON | OFF | OFF |
| | 35% | OFF | ON | OFF | OFF | ON | OFF | OFF | ON | OFF | OFF | ON | OFF | OFF | ON | OFF | OFF | ON | OFF | OFF | ON |
| | 40% | ON | OFF | OFF | ON | OFF | OFF | ON | OFF | OFF | ON | ON | OFF | OFF | ON | OFF | OFF | ON | OFF | OFF | ON |
| | 45% | ON | OFF | OFF | ON | ON | OFF | OFF | ON | ON | OFF | OFF | ON | OFF | OFF | ON | ON | OFF | OFF | ON | OFF |
| | 50% | OFF | ON | ON | OFF | OFF | ON | ON | OFF | OFF | ON | ON | OFF | OFF | ON | ON | OFF | OFF | ON | ON | OFF |
| | 55% | OFF | ON | ON | OFF | OFF | ON | ON | OFF | OFF | ON | ON | OFF | ON | ON | OFF | OFF | ON | ON | OFF | ON |
| | 60% | OFF | ON | ON | OFF | ON | ON | OFF | ON | ON | OFF | OFF | ON | ON | OFF | ON | ON | OFF | ON | ON | OFF |
| | 65% | ON | OFF | ON | ON | OFF | ON | ON | OFF | ON | ON | OFF | ON | ON | OFF | ON | ON | OFF | ON | ON | OFF |
| | 70% | ON | ON | OFF | ON | ON | OFF | ON | ON | OFF | ON | ON | OFF | ON | ON | OFF | ON | ON | OFF | ON | ON |
| | 75% | ON | ON | OFF | ON | ON | OFF | ON | ON | ON | ON | OFF | ON | ON | OFF | ON | ON | ON | ON | OFF | ON |
| | 80% | ON | ON | OFF | ON | ON | ON | ON | OFF | ON | ON | ON | ON | OFF | ON | ON | ON | ON | OFF | ON | ON |
| | 85% | ON | ON | ON | OFF | ON | ON | ON | ON | ON | ON | OFF | ON | ON | ON | ON | ON | ON | OFF | ON | ON |
| | 90% | ON | ON | ON | ON | OFF | ON | ON | ON | ON | ON | ON | ON | ON | OFF | ON | ON | ON | ON | ON | ON |
| | 95% | ON | ON | ON | ON | ON | ON | ON | ON | ON | OFF | ON | ON | ON | ON | ON | ON | ON | ON | ON | ON |
| | 100% | ON | ON | ON | ON | ON | ON | ON | ON | ON | ON | ON | ON | ON | ON | ON | ON | ON | ON | ON | ON |

IMAGE FORMING APPARATUS HAVING FIXING UNIT FOR FIXING UNFIXED TONER IMAGE FORMED ON RECORDING MATERIAL ONTO RECORDING MATERIAL BY HEAT

BACKGROUND OF THE INVENTION

1. Field of the Invention

The present invention relates to an image forming apparatus having a fixing unit by which an unfixed toner image formed on a recording material is fixed onto the recording material by heat.

2. Description of the Related Art

There are known to be various types of recording material heating devices in image forming apparatuses, such as a heat-roller type and a film-heating type. All of such heating devices have a heating element, and temperature management is performed by controlling the supply of power to the heating element such that the apparatus temperature is maintained at a predetermined temperature (e.g., a predetermined image fixing temperature). Among conventional heating devices, film heating-type heating devices are particularly effective and practical (Japanese Patent Laid-Open No. 4-44075).

A film heating type of heating device can use a thin film or heating element that rises in temperature quickly, having a low heat capacity, thus enabling the conservation of energy and the shortening of the wait time (quick starting). Also, in recent years, there has been a proposal for a heating device configured so as to suppress uneven melting caused by unevenness of the recording material, by providing the heating film with an elastic layer (Japanese Patent Laid-Open No. 11-15303). In the temperature control of a film heating type of heating device, the output of a thermistor provided on the heating element is subjected to A/D conversion and then input to the CPU, and in accordance with the result of a comparison between the detected temperature and a target temperature, the supply of power to the heating element is controlled through PID control based on a control table that has been determined in advance. Note that PID control refers to control in which control values are determined by combining proportional control (hereinafter referred to as "P control"), integral control (hereinafter referred to as "I control"), and derivative control (hereinafter referred to as "D control") in accordance with output values from a control target. Also, the control of the supply of power to the heating element is performed by switching the AC voltage on and off using a controlling semiconductor switch (hereinafter referred to as a "triac"), and wave number control or phase control is used in the power supply control system.

Here, wave number control refers to control for using a certain number of waves of an input AC voltage as a predetermined cycle and performing on/off switching in units of one halfwave in the predetermined cycle, and is a system of controlling the power supply rate using the on/off duty cycle in the predetermined cycle. On the other hand, phase control is a system of controlling the phase angle in one wave of the AC input voltage. A characteristic of wave number control is that harmonic current is low and flicker noise is high, and a characteristic of phase control is that flicker noise is low and harmonic current is high. In particular, in recent years, wave number control has often been employed instead of phase control in the case of using a 200 V based commercial power supply, in order to reduce harmonic current. For this reason, there has also been a proposal for an apparatus configured so as to switch between wave number control and phase control depending on the AC input voltage, such as depending on whether the voltage is 200 V or 100 V (Japanese Patent Laid-Open No. 10-333490). There has also been a proposal for combining phase control and wave number control and using phase control in at least one halfwave in wave number control so as to perform more detailed control in which harmonic current is reduced more than in the case of performing only phase control, and the power supply rate update cycle is shorter than that in the case of performing only wave number control (Japanese Patent Laid-Open No. 2003-123941).

Incidentally, with the above-described film heating-type heating devices, and particularly with an apparatus in which the heating film is provided with an elastic layer, there are cases where the heated state of the recording material becomes unstable depending on the entry of the recording material into the heating nip portion. If the recording material enters while the temperature is stable, heat is rapidly absorbed immediately after the recording material enters the heating nip portion, and the temperature of the heating film rapidly decreases. Thereafter, overshooting occurs when the temperature rapidly rises, and thus a large temperature fluctuation occurs in the heating nip portion. In order to avoid this phenomenon, a method has been proposed in which the amount of power supplied to the heating element is corrected before the temperature fluctuation occurs due to the entry of a recording material (Japanese Patent Laid-Open No. 2004-078181). When the temperature of the heating film rapidly decreases along with the entry of the recording material into the heating nip portion, the temperature remains low when this portion again comes into contact with the recording material after the heating film has rotated one time. In other words, the temperature of the heating film decreases in the portion corresponding to the second rotation of the heating film on the recording material, thus resulting in the phenomenon in which image glossiness decreases. On the other hand, the large decrease in the temperature of the heating film due to the entry of the recording material occurs only momentarily, immediately after the heating state has rapidly changed due to the entry of the recording material. Due to performing PID control, the heating state immediately stabilizes to a certain extent, and the decrease in temperature is resolved. Meanwhile, even in the portion corresponding to the second rotation of the heating film on the recording material, image glossiness decreases only in the portion corresponding to the leading edge in the second rotation. However, there is a large difference in image glossiness between the portion at the leading edge of the second rotation of the heating film and the portion at the trailing edge of the first rotation. For this reason, there are cases where the difference in glossiness appears as a prominent change at the border between these portions. This phenomenon is particularly significant when glossy paper has been fed. In order to suppress this change in glossiness, it is necessary to perform more detailed control of the above-described power correction so as to make the glossiness match at the junction between the first rotation and the second rotation. In other words, it is necessary to compensate for the decrease in the temperature of the heating film in the portion corresponding to the leading edge of the second rotation such that even if heat is absorbed at the leading edge of the first rotation, the temperature is the same at the leading edge of the second rotation and the trailing edge of the first rotation.

The mechanism for compensating for a temperature decrease using power correction is as follows. First, the temperature of the heating film surface decreases due to the entry of a recording material. If power correction is not performed, the temperature in this portion remains low, and a change in glossiness appears after one rotation of the heating film as described above. In contrast, assume that power correction for forcibly inputting a predetermined power in anticipation of the entry of the recording material has been performed. In this case, although the temperature of the heating film surface decreases, the power (i.e., thermal energy) forcibly input within one rotation is transmitted to the heating film surface. The amount of decrease in temperature is thus canceled out, and the predetermined temperature is restored when the leading edge in the second rotation of the heating film, which corresponds to the recording material entry portion of the heating film, again comes into contact with the recording material. As can be understood from this mechanism, the portion in which the heat generated by the power correction heats the inner surface of the heating film needs to substantially match the portion in which the temperature decreased due to the entry of the recording material. Such a case requires stricter precision than the case of simply stabilizing temperature control. With a recording material such as glossy paper in particular, the glossiness is very highly sensitive to temperature, and a slight temperature difference appears as a glossiness difference (i.e., a change in glossiness), and therefore the range in which the surface temperature is to be controlled is very narrow.

In order to cause the trailing edge of the first rotation and the leading edge of the second rotation of the heating film to have the same temperature, it is necessary to perform power correction for accurately compensating for the temperature decrease at the leading edge in the second rotation. Specifically, high precision is required for not only the amount of power, but also the time at which power correction is performed. This is because change in glossiness occurs in a delta function manner. Accordingly, compensating for the temperature reduction so as to resolve this problem requires the power to be compensated for at a precise time in a delta function manner with respect to the time at which change in glossiness occurs. If the power correction time deviates even slightly from the appropriate correction time, it is not possible to sufficiently compensate for the temperature decrease due to insufficient power, or hot offsetting or the like occurs due to excessive power input. In other words, if the time at which power correction is started deviates even slightly, the effect of the power correction fades. However, with an apparatus employing wave number control, it is not possible to perform correction when power correction is to be performed with respect to the entry of a recording material. Accordingly, wave number control has the issue that a temperature fluctuation due to the entry of a recording material cannot be sufficiently suppressed. This is due to the fact that the update frequency is low since the power supply rate update cycle in wave number control is a unit of several halfwaves, and as a result, there are almost no cases in which the update time matches the power correction time.

FIG. 15 is a timing chart showing the update cycle and update timing for the power supply rate in wave number control and phase control, and the timing of recording material entry and power correction. In this example, the power supply rate update cycle in wave number control is assumed to be 20 halfwaves. The graph entitled "UPDATE CYCLE IN WAVE NUMBER CONTROL" shows the power supply rate update timing in wave number control. The graph entitled "UPDATE CYCLE IN PHASE CONTROL" shows the power supply rate update timing in phase control. Power correction is executed at time C. The recording material enters the heating nip portion at time D. In the example shown in FIG. 15, power correction is started 150 msec before the time when the recording material enters the heating nip portion, and power correction ends when 50 msec has elapsed after the time when the recording material entered the heating nip portion. The power supply rate update cycle is long in wave number control. For this reason, there is a large difference (deviation) between the appropriate correction time and the time when correction is actually performed. Since the power supply rate is controlled in intervals of 20 halfwaves in the example shown in FIG. 15, a deviation (delay) of up to 200 msec (in the case of 50 Hz) occurs from when the power correction start instruction is issued until correction is actually executed. In this case, the power correction period is from 150 msec before recording material entry until 50 msec after entry, which is 200 msec in total. For this reason, in the case where the deviation has reached the maximum value, power correction is started at the power correction end time. In other words, a power correction end instruction is actually issued at the same time as the start of power correction, and therefore power correction is not performed.

In the above-described example, the power supply rate is updated once the correction start instruction has been issued. For this reason, the timing deviation is always in the direction of delay of the execution of correction. In contrast, the power correction start time is known in advance. For this reason, based on the assumption of deviation, the maximum amount of deviation can be somewhat reduced by performing correction upon the arrival of the power supply rate update time that is closest to the power correction start time. However, even in this case, the amount of deviation can be up to ±100 msec from the appropriate power correction time.

FIGS. 16A to 16C are graphs showing the state of the heating film surface temperature in cases where the power correction time and the power supply rate update time deviate from each other. In the graphs of FIG. 16A to 16C, the horizontal axis indicates time (msec), and the vertical axis indicates the heating film surface temperature (° C.). FIG. 16A shows the case where power correction is performed at the appropriate time, FIG. 16B shows the case where the deviated start of power correction is before the appropriate time, and FIG. 16C shows the case where the deviated start of power correction is after the appropriate time. The heating film temperature decreases due to the recording material having entered the heating nip portion. However, in FIG. 16A, the difference in the heating film surface temperature before and after the entry of the recording material into the heating nip portion falls within approximately Δ2 deg. In contrast, in FIG. 16B, the surface temperature rises a large amount before the entry into the heating nip portion. For this reason, the difference in the heating film surface temperature before and after the entry into the heating nip portion is Δ8 deg. Also, in FIG. 16C, the heating film temperature decreases a large amount due to the recording material having entered the heating nip portion. For this reason, the difference in the heating film surface temperature is approximately Δ8 deg, as expected.

As is clear in FIG. 16B, in the case where power correction is performed at a deviated time, if correction is performed before the appropriate time, the heating nip portion temperature rises excessively, and overheating occurs. If a recording material holding a toner image enters in this state, the toner melts excessively, and hot offsetting will occurs. Also, since a large amount of power is supplied before the appropriate time, the heating film temperatures rises excessively in the period up to when the recording material enters, and the glossiness of the recording material rises in the portion corresponding to the trailing edge of the first rotation of the film. Accordingly, horizontal band shaped glossiness unevenness occurs such that the change between the trailing edge of the first rotation and the leading edge of the second rotation is emphasized. On the other hand, if correction is performed after the appropriate time as shown in FIG. 16C, it is not possible to compensate for the decrease in heat due to recording material entry, and the temperature decreases by a large amount. In this case, the glossiness decreases excessively in the portion corresponding to the second rotation of the heating film. Specifically, the change between the trailing edge of the first rotation and the leading edge of the second rotation becomes prominent, and glossiness unevenness occurs. In order to address this issue, it is possible to shorten the power supply rate update cycle, but in this case, it is not possible to perform detailed setting of the power supply rate since the number of waves in the update cycle decreases, thus bringing about an obstacle in temperature control.

Incidentally, timing deviation occurs in the case of phase control as well. Although the maximum value of deviation is 1 full wave, which is 20 msec (in the case of 50 Hz), even this extent of deviation cannot be said to have no influence. However, as a result of examination, the inventors found that at this extent of deviation, the glossiness unevenness manages to fall within an allowable range. To put it the other way around, unless phase control is used, timing deviation cannot be suppressed to an allowable level. However, since phase control has the issue of harmonic current, there are necessarily cases where phase control cannot be employed, as described above. In particular, in Europe where the commercial alternating-current power supply voltage is 200 V, regulations regarding harmonic current are strict, and it is necessary to use wave number control instead of phase control.

Also, with the wave number control disclosed in Japanese Patent Laid-Open No. 2003-123941, the power supply rate update cycle can be shortened in control performed using phase control in at least one halfwave in the power supply rate update cycle, thus having the effect of somewhat of an improvement regarding this problem, that is to say, the problem of deviation of the power correction timing. However, when the number of waves in the update cycle decreases as a result of shortening the power supply rate update cycle, the number of waves to perform phase control relatively increases, and therefore harmonic current increases. Also, as described above, deviation of the power correction timing manages to fall within the allowable range if phase control is used in all of the waveforms, and therefore there is a limit to the suppression of deviation of the power correction timing even in the case of using waveforms combining phase control and wave number control.

SUMMARY OF THE INVENTION

The present invention has been achieved in light of such circumstances, and a feature thereof is to prevent a decrease in image quality even in the case where deviation has occurred in power correction timing and power supply rate update timing.

The present invention provides an image forming apparatus comprising an image forming unit, a fixing unit, a temperature detection unit and a control unit. The image forming unit forms an unfixed toner image on a recording material. The fixing unit fixes the unfixed toner image on the recording material onto the recording material by heat. The temperature detection unit detects the temperature of the fixing unit. The control unit controls the image forming apparatus. The control unit updates a power supplied from an alternating-current power supply to the fixing unit to a power in accordance with the temperature detected by the temperature detection unit per a power update period prescribed by a predetermined number of consecutive halfwaves of the alternating-current power supply. The control unit corrects the power supplied to the fixing unit at a time when the recording material enters the fixing unit with a correction power based on a difference between an update time of the power updating period and the time when the recording material enters the fixing unit.

Further features of the present invention will become apparent from the following description of exemplary embodiments with reference to the attached drawings.

BRIEF DESCRIPTION OF THE DRAWINGS

FIG. 4 is a diagram showing waveform patterns of wave number control according to Embodiment 1.

FIG. 6A is a table showing addition values to be added to the power supply rate in correction corresponding to deviation amounts according to Embodiment 1.

FIG. 6B is a table showing an example of a waveform pattern for each power supply rate.

FIG. 9 is a table showing addition values to be added to the power supply rate in correction corresponding to deviation amounts according to Embodiment 2.

FIGS. 10A to 10E are diagrams showing waveform patterns of wave number control in a power correction period according to Embodiment 2.

FIG. 13 is a table showing addition values to be added to the power supply rate in correction corresponding to deviation amounts according to Embodiment 2.

FIGS. 14A to 14E are diagrams showing waveform patterns of wave number control in a power correction period according to Embodiment 2.

DESCRIPTION OF THE EMBODIMENTS

A detailed description of embodiments of the present invention is given below with reference to the drawings. It should be noted that the dimensions, material, shape, relative positions, and the like of constituent parts disclosed in these embodiments are intended to be appropriately modified according to various conditions and the configuration of the apparatus to which the invention is applied, and the range of the invention is not intended to be limited to the following embodiments.

Embodiment 1

Configuration of Image Forming Apparatus

Figure 1A:
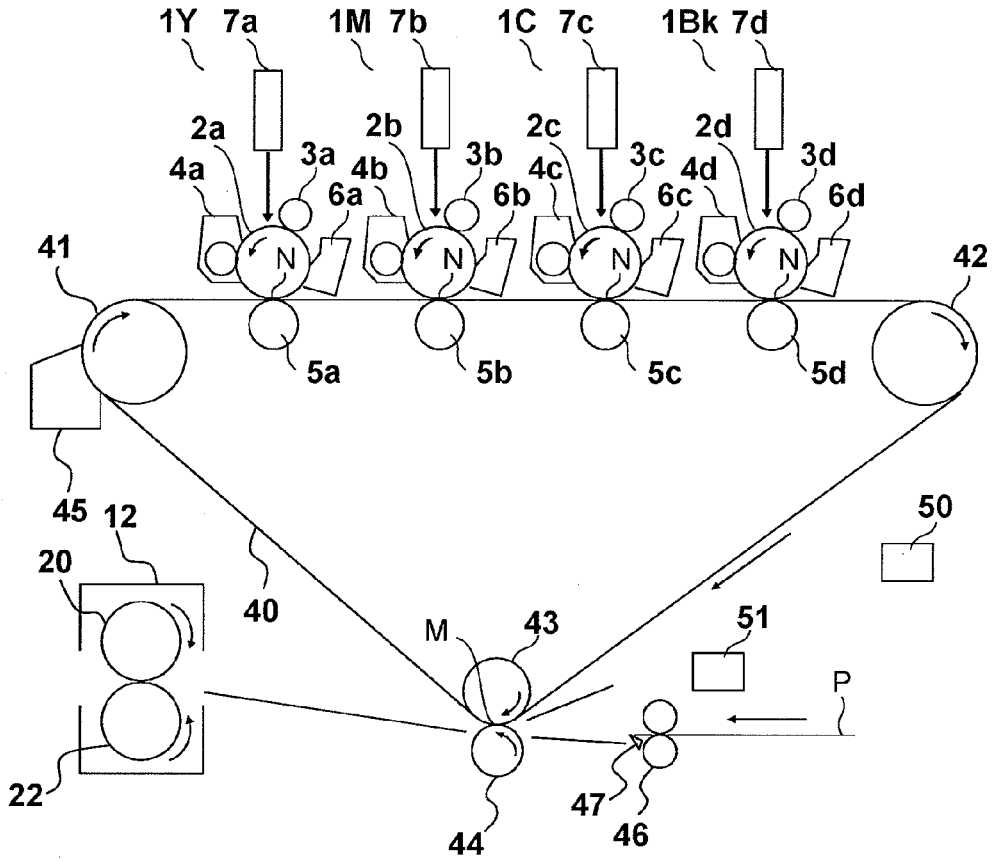
FIG. 1A is a schematic configuration diagram of a color image forming apparatus according to Embodiments 1 and 2.

FIG. 1A is a schematic configuration diagram showing a color image forming apparatus according to Embodiment 1. The image forming apparatus of the present embodiment is an electrophotographic tandem full-color printer. This image forming apparatus includes four image forming units, namely an image forming unit 1Y for forming a yellow image, an image forming unit 1M for forming a magenta image, an image forming unit 1C for forming a cyan image, and an image forming unit 1Bk for forming a black image, and these four image forming units are aligned in a row with a constant interval. Photosensitive drums 2*a*, 2*b*, 2*c*, and 2*d* are disposed in the image forming units 1Y, 1M, 1C, and 1Bk respectively. Note that the letters a, b, c, and d represent to which of the image forming units 1Y, 1M, 1C, and 1Bk a unit belongs, and are sometimes omitted in the following description. Disposed in the periphery of each photosensitive drum 2 are a charging roller 3, a developing device 4, a transfer roller 5, and a drum cleaning device 6. Also, an exposing device 7 is disposed above each space between a charging roller 3 and a developing device 4. The developing devices 4 respectively house yellow toner, magenta toner, cyan toner, and black toner. Primary transfer units N of the photosensitive drums 2 in the image forming units 1Y, 1M, 1C, and 1Bk are each in contact with an endless intermediate transfer belt 40 serving as a transfer medium. The intermediate transfer belt 40 is wound around a driving roller 41, a support roller 42, and a secondary transfer opposing roller 43, and is rotated in the arrow direction (clockwise direction) by driving of the driving roller 41. The transfer rollers 5 for primary transfer abut against the corresponding photosensitive drums 2 via the intermediate transfer belt 40 in the corresponding primary transfer units N.

The secondary transfer opposing roller 43 abuts against a secondary transfer roller 44 via the intermediate transfer belt 40, and thus a secondary transfer unit M is formed. The secondary transfer roller 44 is disposed so as to be capable of separation from the intermediate transfer belt 40. A belt cleaning device 45, which is for removing and recovering remaining transfer toner that remains on the surface of the intermediate transfer belt, is disposed in the vicinity of the driving roller 41 outside the intermediate transfer belt 40. Also, a heating device 12 is disposed on the downstream side of the secondary transfer unit M in the conveying direction of a recording material P. Furthermore, this image forming apparatus is provided with an environment sensor 50 for measuring the temperature and the humidity and a media sensor 51 for detecting, for example, the type and length of the recording material.

When an image formation operation start signal (printing start signal) is issued, the photosensitive drums 2 of the image forming units 1Y, 1M, 1C, and 1Bk, which are driven so as to rotate at a predetermined process speed, are uniformly charged with a negative polarity by the charging rollers 3. A laser output unit (not shown) in each of the exposing devices 7 converts an input color-separated image signal into an optical signal, and the exposing devices 7 form electrostatic latent images on the charged photosensitive drums 2 by subjecting them to scanning and exposure with laser light, which is the converted optical signal. Thereafter, the developing device 4*a*, to which a developing bias with the same polarity as the charge polarity of the photosensitive drum 2*a* (negative polarity) has been applied, causes yellow toner to electrostatically adsorb to the photosensitive drum 2*a*, on which an electrostatic latent image was formed, in accordance with the charge potential of the photoreceptor surface, thus visualizing the electrostatic latent image as a toner image. The transfer roller 5*a*, to which a primary transfer bias (having the opposite polarity (positive polarity) of the toner) has been applied in the primary transfer unit N, then performs primary transfer of the yellow toner image onto the rotating intermediate transfer belt 40. After the yellow toner image has been transferred, the intermediate transfer belt 40 is rotated to the image forming unit 1M side. In the image forming unit 1M as well, a magenta toner image similarly formed on the photosensitive drum 2*b* is transferred in the primary transfer unit N so as to be superimposed on the yellow toner image on the intermediate transfer belt 40. Similarly, cyan and black toner images formed on the photosensitive drums of the image forming units 1C and 1Bk are transferred in the corresponding primary transfer units N so as to be superimposed in the stated order onto the yellow and magenta toner images that were transferred so as to be superimposed on the intermediate transfer belt 40, and thus a full-color toner image is formed on the intermediate transfer belt 40.

Meanwhile, the recording material P is fed and conveyed by a paper feeding mechanism (not shown), and the conveying is stopped when the leading edge position has been detected by a registration sensor 47 (recording material detection), and the recording material P waits while being held by registration rollers 46. The registration rollers 46 then convey the recording material (transfer medium) P to the secondary transfer unit M in conformity with the time when the leading edge of the full-color toner image on the intermediate transfer belt 40 moves to the secondary transfer unit M. Next, the secondary transfer roller 44, to which a secondary transfer bias (having the opposite polarity (positive polarity) of the toner) has been applied, performs secondary transfer of the full-color toner image all at once onto the recording material P. The recording material P on which the full-color toner image has been formed is conveyed to the heating device 12, in which the full-color is heated and pressed in a heating nip portion between a heating film 20 and a pressure roller 22 serving as a pressing member so as to melt and fix the full-color toner image onto the surface of the recording material P, and thereafter the recording material P is discharged to the outside as an output image of the image forming apparatus. This series of image forming operations then ends.

Note that the environment sensor 50 for detecting the temperature and the humidity is disposed within the image forming apparatus, and the fixing conditions and the charging, developing, primary transfer, and secondary transfer biases can be modified according to the detected temperature and humidity. The detected temperature and humidity are also used for adjusting the density of the toner image on the recording material P and achieving appropriate transfer and fixing conditions. Furthermore, the media sensor 51 disposed within the image forming apparatus makes a determination regarding the recording material, and the transfer biases and fixing conditions are modified according to the recording material P. Also, remaining primary transfer toner that remains on the photosensitive drums 2 in the above-described primary transfer is removed and recovered by the drum cleaning devices 6. Remaining secondary transfer toner that remains on the intermediate transfer belt 40 after secondary transfer is removed and recovered by the belt cleaning device 45.

Configuration of Media Sensor

Figure 1B:
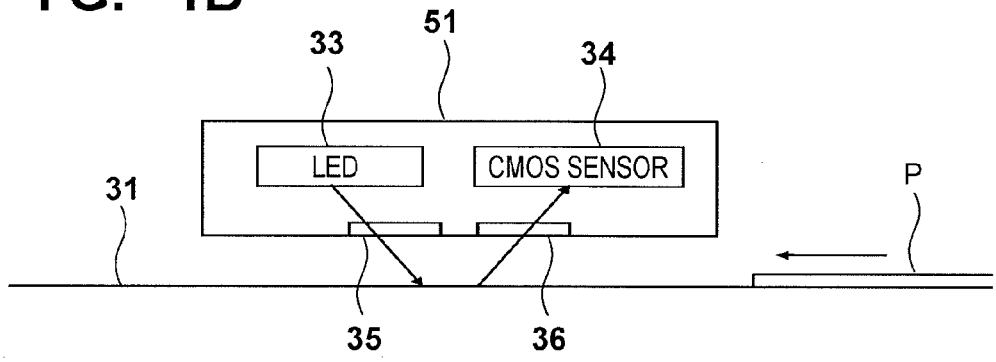
FIG. 1B is a schematic configuration diagram of a media sensor.

As shown in FIG. 1A, the media sensor 51 is disposed within the image forming apparatus of the present embodiment. FIG. 1B is a schematic configuration diagram of the media sensor 51. The media sensor 51 has an LED 33 serving as a light source, a CMOS sensor 34 serving as a reading part, and lenses 35 and 36 serving as imaging lenses. Light from the LED 33 serving as the light source is irradiated via the lens 35 onto the base of a recording material conveying guide 31 or onto the surface of the recording material P being conveyed over the recording material conveying guide 31. The reflected light is collected via the lens 36 and focused onto the CMOS sensor 34. Accordingly, an image of the surface of the recording material conveying guide 31 and the recording material P is read so as to acquire analog output indicating the surface state of the paper fibers, and the analog output is furthermore subjected to A/D conversion so as to obtain digital data. A gain operation and a filter operation are programmably performed on the digital data by a control processor (not shown). An image comparison operation is then performed, and a paper type (thickness, basis weight, etc.) is determined based on the result of the image comparison operation.

Note that apparatus operation speeds that differ according to the paper mode are used in the present embodiment. For example, in the case of printing media P having basis weights of 60 to 70 g/m$^2$ and 71 to 90 g/m$^2$, the apparatus is caused to operate in a thin paper mode and a normal mode respectively, using the normal speed and different fixing temperatures. On the other hand, in the case of a recording material P having a basis weight of 91 to 128 g/m$^2$, the apparatus is caused to operate in a thick paper mode 1, using ½ of the normal speed. In the case of a recording material P having a basis weight of 129 to 220 g/m$^2$, the apparatus is caused to operate in a thick paper mode 2, using ⅓ of the normal speed. Reducing the operation speed as the paper thickness and basis weight increases in this way enables obtaining more favorable fixing characteristics. Note that depending on the apparatus, the same operation speed can be used regardless of the basis weight.

Overview of Heating Device (1) Configuration of Heating Device

Figure 2A:
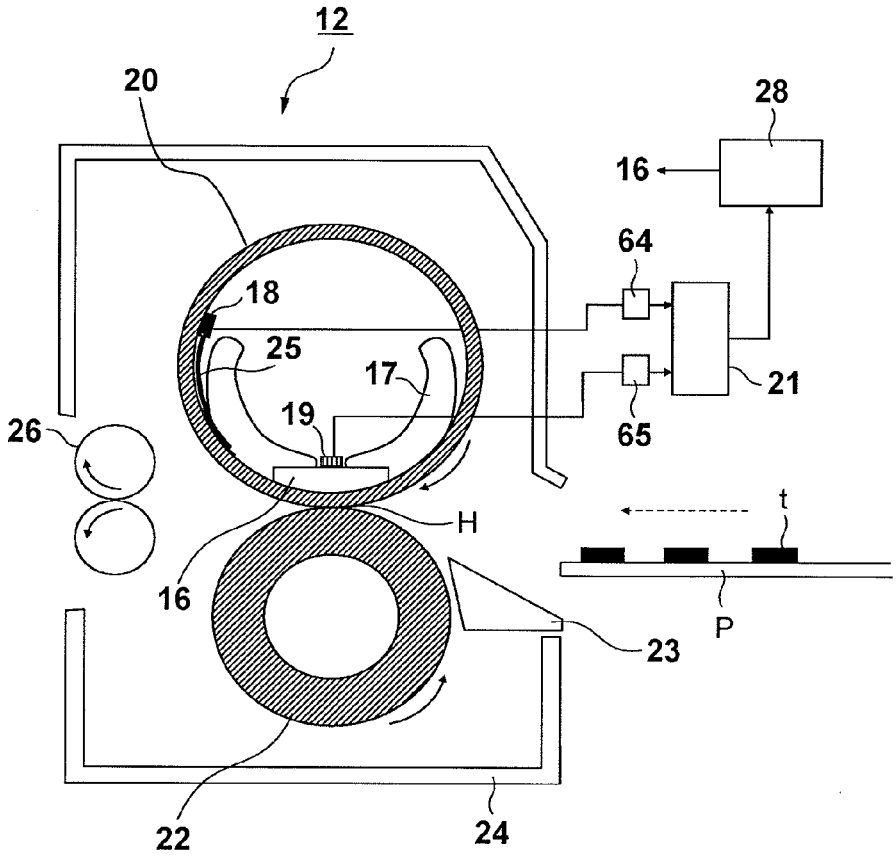
FIG. 2A is a cross-sectional view of a heating device according to Embodiments 1 and 2.

FIG. 2A is a cross-sectional view of the configuration of the heating device 12 according to the present embodiment. The heating device 12 employs a film heating system. The heating film 20 is loosely fitted in a film guide. A pressure rotating member performs driving, and the heating film 20 follows the rotation of the pressure rotating member. This is also sometimes called a pressure rotating member driving system (tensionless type). The heating film 20 is a cylindrical (endless belt shaped) member made up of a film provided with an elastic layer. A heater holder 17 serves to hold a heater 16 and guide the heating film 20. The heater 16 is a heating element (heat source), and is disposed on the lower face of the heater holder 17 along the lengthwise direction of the heater holder 17. The pressure roller 22 is manufactured by forming a silicone rubber layer on a cored bar, and covering the silicone rubber layer with a PFA resin tube. Both end portions of the cored bar are rotatably supported by a bearing provided between side plates (not shown) on the background side and the foreground side of a device frame 24. Above the pressure roller 22, a heating film unit including the heater 16, the heater holder 17, the heating film 20, and the like is disposed so as to be parallel with the pressure roller 22, with the heater 16 side facing downward. Both end portions of the heater holder 17 are biased toward the pressure roller 22 by a pressing mechanism that is not shown. Accordingly, the downward-facing surface of the heater 16 is pressed against the elastic layer of the pressure roller 22 via the heating film 20 with a predetermined pressing force, thus forming a heating nip portion H having a predetermined width necessary for heat fixing. The pressing mechanism has a press-canceling mechanism, and is configured to cancel the pressing so as to facilitate removal of the recording material P during jam processing or the like.

The main thermistor 18, which serves as a temperature detection unit, is disposed so as to not be in contact with the heater 16. In the present embodiment, the main thermistor 18 is elastically in contact with the inner surface of the heating film 20 above the heater holder 17, and detects the temperature of the inner surface of the heating film 20. The main thermistor 18 is attached to the tip of an arm 25 that is fixed to and supported by the heater holder 17. Accordingly, due to elastic swinging of the arm 25, the main thermistor 18 is held so as to always be in contact with the inner surface of the heating film 20, even if the movement of the inner surface of the heating film 20 becomes unstable. The sub thermistor 19, which serves as another temperature detection unit, is disposed in a location that is closer to the heater 16 than the main thermistor 18 is. In the present embodiment, the sub thermistor 19 is in contact with the back surface of the heater 16, and detects the temperature of the back surface of the heater 16. The main thermistor 18 and the sub thermistor 19 are connected to a control circuit unit (hereinafter referred to as the "CPU 21") via A/D converters 64 and 65 respectively. The CPU 21 determines control content of temperature adjustment of the heater 16 based on detected temperature output from the main thermistor 18 and the sub thermistor 19, and controls the supply of power to the heater 16 via a heater driving circuit unit 28 that serves as a power supply unit. In other words, the CPU 21 functions as a power control unit. Note that although the main thermistor 18 detects the temperature of the inner surface of the heating film 20 in the present embodiment, a configuration is possible in which the main thermistor 18 is disposed on the back surface of the heater 16 likewise to the sub thermistor 19, and directly detects the temperature of the heater 16.

An entrance guide 23 serves to guide the recording material P such that after the recording material P has exited a secondary transfer nip M, it is accurately guided to the heating nip portion H, which is the portion of contact under pressure between the heating film 20 and the pressure roller 22. After the recording material P has passed through the heating nip portion H, paper discharge rollers 26 discharge the recording material P to the outside of the image forming apparatus.

(2) Pressure Roller

The pressure roller 22 is driven by a driving unit (not shown) so as to rotate at a predetermined circumferential velocity in the arrow direction shown in FIG. 2A. A rotative force acts on the cylindrical heating film 20 due to a contact friction force in the heating nip portion H between the outer surface of the pressure roller 22 and the heating film 20 resulting from rotational driving of the pressure roller 22. The heating film 20 is then driven so as to rotate in the arrow direction shown in FIG. 2A around the heater holder 17 while the inner surface side of the heating film 20 slides along the downward-facing surface of the heater 16 in close contact therewith. When the pressure roller 22 is driven so as to rotate, the cylindrical heating film 20 accordingly enters a following-rotation state, and temperature adjustment is performed so as to raise the temperature of the heater 16 to a predetermined temperature by supply power thereto. In this state, the recording material P holding an unfixed toner image t is guided along the entrance guide 23 into the heating nip portion H between the heating film 20 and the pressure roller 22. The recording material P is then conveyed while being gripped by the heating nip portion H, such that the side of the recording material P holding the toner image is in close contact with the outer surface of the heating film 20. In the gripping/conveying processing, heat is applied from the heater 16 to the recording material P via the heating film 20, and the unfixed toner image t on the recording material P is heated and pressed so as to be melted and fixed to the recording material P. Then, after having passed through the heating nip portion H, the recording material P is separated from the heating film 20 in a curved manner, and is discharged by the paper discharge rollers 26.

(3) Heating Film

The heating film 20 is a cylindrical (endless belt shaped) member made up of a film provided with an elastic layer. In the present embodiment, the heating film is designed such that when the temperature is to be raised from room temperature, approximately 1000 W power is supplied to the heater 16 in order to raise the temperature of the heating film 20 to 190° C. within 20 seconds.

(4) Thermistors

Figure 2B:
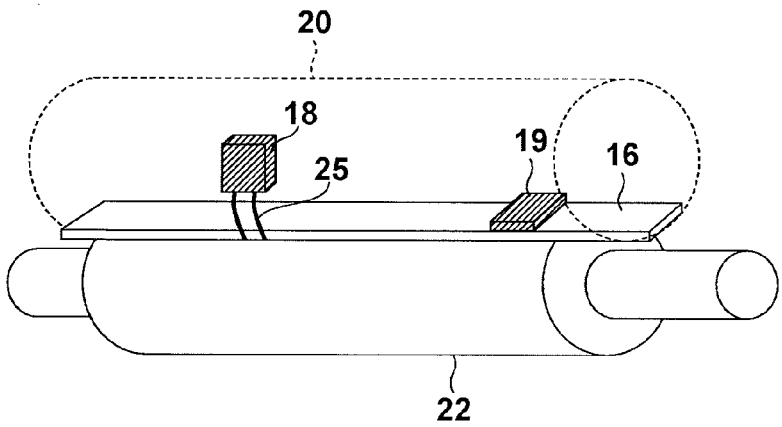
FIG. 2B is a perspective diagram showing a positional relationship between a heater, a main thermistor, and a sub thermistor.

FIG. 2B is a perspective diagram showing the positional relationship between the heater 16, the main thermistor 18, and the sub thermistor 19 of the heating device according to the present embodiment. The main thermistor 18 is disposed in the vicinity of the center of the heating film 20 with respect to the lengthwise direction. The sub thermistor 19 is disposed in the vicinity of an end portion of the heater 16. These thermistors are disposed so as to respectively be in contact with the inner surface of the heating film 20 and the back surface of the heater 16. The main thermistor 18 is used as a unit for detecting the temperature of the heating film 20, which is a temperature closer to the temperature of the heating nip portion H. Accordingly, during normal operation, temperature adjustment control (i.e., control of the power supplied to the heater 16) is performed such that the temperature detected by the main thermistor 18 is a target temperature. Note that the main thermistor 18 may be disposed on the back surface of the heater 16, as described above. In this case, temperature adjustment control is performed such that the temperature of the back surface of the heater 16 is the target temperature. The sub thermistor 19 detects the temperature of the heater 16, which is the heating element, and serves to perform monitoring such that the temperature of the heater 16 does not reach or exceed a predetermined temperature. The sub thermistor 19 also monitors for a temperature rise at the end portion of the heater 16 and overshooting of the temperature of the heater 16 when the temperature is raised. If, for example, the temperature of the end portion of the heater 16 rises and exceeds the predetermined temperature, control for, for example, lowering the throughput (number of images formed per unit time) is performed so as to prevent any further rise in the temperature of the end portion.

(5) Heater

Figure 3A:
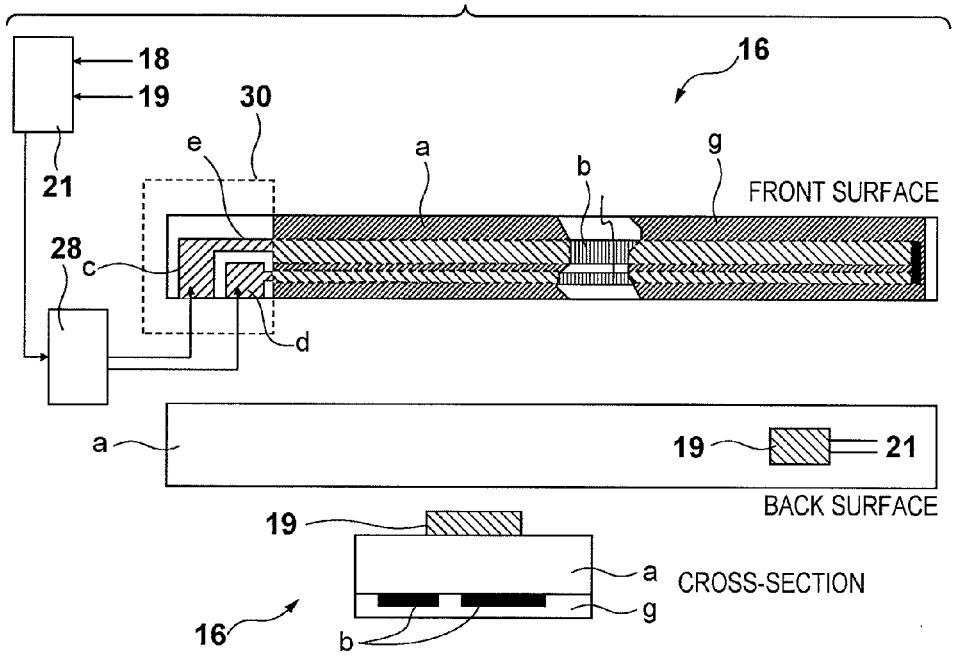
FIG. 3A is a configuration diagram of a ceramic heater according to Embodiments 1 and 2.

The heater 16 is a ceramic heater formed by providing a pressure-resistant glass coat on a resistance heating element. FIG. 3A is a diagram showing the structure (front surface, back surface, and cross-section) of an example of such a ceramic heater. In FIG. 3A, the heater 16 has a resistance heating element layer b on the front surface of a substrate a, which is long in a direction orthogonal to the paper feeding direction. The heater 16 also has a first electrode unit c, a second electrode unit d, and an extended wiring unit e, as a power supply pattern for supplying power to the resistance heating element layer b. The heater 16 furthermore includes a glass coat g formed over the resistance heating element layer b and the extended wiring unit e for protection and insulation, and the sub thermistor 19 and the like provided on the back surface side of the substrate a.

The heater 16 is fixed to and supported by the heater holder 17 such that the front surface side of the heater 16 faces downward. A power supply connector 30 is mounted to the side of the heater 16 on which the electrode units c and d are provided, and when power is supplied from the heater driving circuit unit 28 to the electrode units c and d via a power supply connector 30, the resistance heating element layer b generates heat, and the temperature of the heater 16 rises rapidly. The heater driving circuit unit 28 is controlled by the CPU 21. At the time of image formation, when the rotation of the pressure roller 22 is started, the heating film 20 follows this rotation, and as the temperature of the heater 16 rises, the temperature of the inner surface of the heating film 20 also rises. The supply of power to the heater 16 is controlled by PID control, and the supply of power to the heater 16 is controlled by the CPU 21 such that the temperature of the inner surface of the heating film 20 (i.e., the temperature detected by the main thermistor 18) reaches 190° C.

Figure 3B:
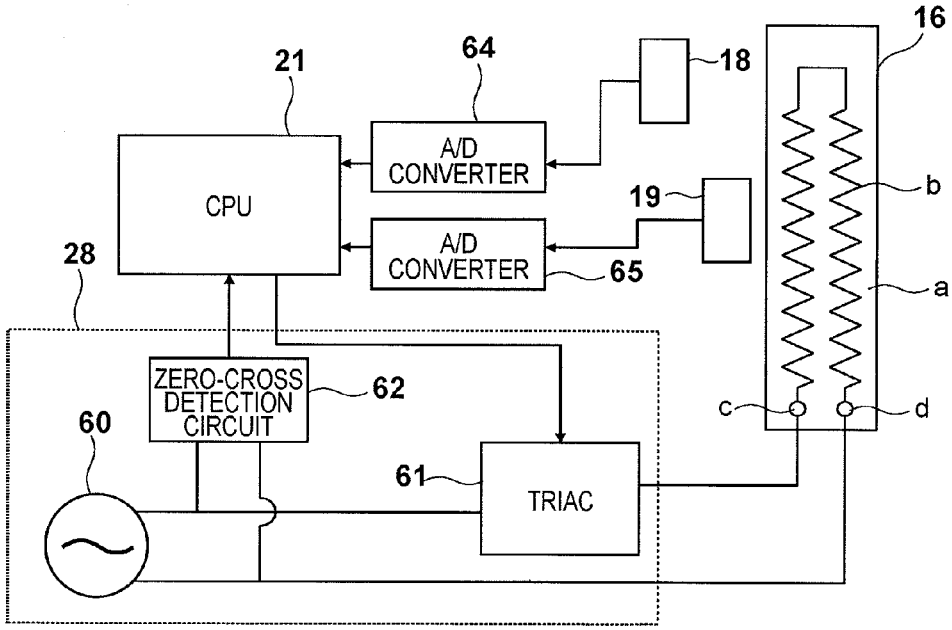
FIG. 3B is a control block diagram of the heating device.

FIG. 3B is a control block diagram including the CPU 21 and the heater driving circuit unit 28 of the fixing device. The power supply electrode units c and d of the heater 16 are connected to the heater driving circuit unit 28 via a power supply connector (not shown). The heater driving circuit unit 28 has an alternating-current power supply 60, a triac 61, and a zero-cross detection circuit 62. The triac 61 is controlled by the CPU 21. The triac 61 performs the supply and interruption of power to the resistance heating element layer b of the heater 16. The CPU 21 internally includes, for example, a ROM, a RAM, and a timer used in time measurement, all of which are not shown. The ROM stores various types of data and a program for controlling the image formation operations of the image forming apparatus, and the RAM is used for, for example, temporary storage and data calculation necessary for controlling the image formation operations of the image forming apparatus.

The zero-cross detection circuit 62 detects zero-cross in an AC waveform flowing from the alternating-current power supply 60 to the heater 16, and transmits a zero-cross signal to the CPU 21. The CPU 21 controls the triac 61 based on the zero-cross signal. The temperature of the entirety of the heater 16 rapidly rises due to power being supplied from the heater driving circuit unit 28 to the resistance heating element layer b of the heater 16 in this way. Output from the main thermistor 18 for detecting the temperature of the heating film 20 and the sub thermistor 19 for detecting the temperature of the heater 16 is input to the CPU 21 via the A/D converters 64 and 65 respectively. Based on the information indicating the temperature of the heating film 20 from the main thermistor 18, the CPU 21 performs control such that the temperature of the heating film 20 is maintained at the predetermined target temperature, by performing PID control of the power supplied to the heater 16 by the triac 61.

Method of Controlling Power Supplied to Heater

In the present embodiment, wave number control is used as the method of controlling power supply. In the wave number control of the present embodiment, the power supply rate is updated in units of a predetermined number of halfwaves, such as in units of 20 halfwaves. Specifically, the power supply rate is controlled in 5% increments from 0 halfwaves (0% power supply) to 20 halfwaves (100% power supply), and the power supply rate update cycle is 200 msec in the case of a 50 Hz alternating-current power supply. The power supply rate is updated at each power supply rate update cycle (one control cycle). Accordingly, during apparatus operation, the power supply rate update time is consecutively reached at a predetermined cycle. Also, in the case of actually supplying power in the present embodiment, power is supplied using a waveform that is in accordance with a power supply rate set through PID control, using waveform patterns of AC voltages that have been set in advance for respective power supply rates. FIG. 4 shows waveform patterns in the wave number control according to the present embodiment. The first column shows total power supply rates, that is to say, control levels. Accordingly, it is possible know at which halfwaves the power supply is to be switched on (i.e., power is to be supplied) in one control cycle (20 halfwaves in the present example). In this table, "ON" represents switching on for the entirety of one halfwave, and "OFF" represents switching off for the entirety of one halfwave. The waveform patterns shown in FIG. 4 are stored in a storage unit (not shown) in the apparatus. Note that the same applies to other waveform patterns described below.

Also, in the present embodiment, PID control is stopped 200 msec before the entry of the recording material P in the heating nip portion H, and power correction for supplying a predetermined power is performed from that time until 0 msec has elapsed since the entry of the recording material P. The predetermined power and predetermined time for which the PID control is stopped and power is supplied is set so as to minimize heating unevenness (change in glossiness) that occurs between the trailing edge of the first rotation and the leading edge of the second rotation of the heating film 20 when the recording material P is heated by the heating film 20. In actual operation, the power supply is controlled by adding a correction amount to the power supply rate selected through PID control during normal temperature control before the start of power correction. For example, in the case of adding +10% to the power correction when the power supply rate of 20% has been selected in PID control, the power supply rate becomes 20%+10%=30%. With this method, the power supply rate selected in PID control differs depending on the apparatus state, such as the heating condition of the image forming apparatus, and therefore the power supply rate also differs according the apparatus state when correction is performed. However, since the amount of heat held by the apparatus differs due to thermal storage and the like up to that time, this control that can reflect the apparatus state can be said to be useful in terms of resolving the problem of heating unevenness. Note that a configuration is possible in which the actual values of power supplied in the case of performing correction is set to fixed values (e.g., 100 W), and such fixed values are stored as a table in the storage unit of the apparatus.

Note that the reason the power correction is started before the entry of the recording material P when paper feeding is started is to take into consideration the time from when the corrected power is actually supplied until the temperature of the heater 16 rises. Specifically, since the heater temperature does not sufficiently follow rapid changes in the supply of power, somewhat of a time lag occurs before the actual power supply is reflected in the temperature. Also, heat is of course not immediately transferred due to thermal contact resistance between the heater 16 and the inner surface of the heating film. Accordingly, if heat is to be appropriately supplied to the portion of the heating film 20 corresponding to the leading edge of the recording material, it is too late if the heat is supplied once the leading edge of the recording material P has entered the heating nip portion H. This amount of time lag is therefore anticipated when determining the time when the power correction is started in the sequence, and in the present embodiment, this time is 200 msec before the entry of the recording material P into the heating nip portion H.

Incidentally, in the present embodiment, this time is set with a slight margin with respect to the time when the recording material P enters the heating nip portion H. Specifically, the time when heat from the heater 16 is reflected in the temperature of the inner surface of the heating film ideally matches the time of the entry of the recording material P. However, power correction is started at a time slightly earlier than that time. This is because it is difficult to match power correction with the recording material entry time when fluctuation in heat transfer is taken into consideration. This is based on the design-related determination that performing adjustment such that the film temperature becomes somewhat high due to starting power correction starts somewhat early has less of a negative influence on image quality than the case where the film temperature decreases due to power correction being late. Note that even a slight increase in this margin causes a rise in the risk of hot offsetting.

Also, in the present embodiment, differences in heat capacity according to the basis weight ($g/m^2$) of the recording material P are taken into consideration when correcting the power supplied to the heater 16. In other words, the power used in correction is changed according to the basis weight of the recording material P. This corrected power is a power determined in advance based on data obtained in experimentation. In the present embodiment, the power supplied to the heater 16 is corrected in accordance with a table of necessary power values separated according the paper mode (mode selected according to the type of recording material). Due to a user designating a print mode (paper mode), the CPU 21 receives printing mode information along with a print signal from a host computer (not shown), and determines the power to be supplied during paper feeding. It is also possible to use the result of a determination made by the media sensor 51, regardless of the designation made by the user.

In the above configuration, it is ideal for the scheduled power correction start time to match the power supply rate update time. In such a case, it is possible to diminish the appearance of a change in glossiness that occurs at a location in the image on the recording material corresponding to the boundary between the first rotation and the second rotation of the heating film 20 due to a decrease in the temperature of the heating film 20 caused by the entry of the recording material P into the heating nip portion H. However, it is not always the case that the actual power correction start time matches the power supply rate update time. Deviation between the power correction start time and the update time cause hot offsetting and the like to occur, and actually reduces image quality, as described above. In view of this, in the present embodiment, deviation is detected between the ideal scheduled power correction start time that has been set and the time when power correction is actually performed according to the power supply rate update time, and the supply of power in power correction is set differently according to the amount of deviation.

The ideal scheduled power correction start time is determined based on the time when the recording material P enters the heating nip portion H as described above (200 msec before entry in the present embodiment). As is clear from this operation principle, power correction needs to be executed before the entry of the recording material P into the heating nip portion H. It is therefore necessary to predict the time when the recording material P will enter the heating nip portion H. In the present embodiment, the time of the entry of the recording material P into the heating nip portion H is predicted based on the time when conveying of the recording material P by the registration rollers 46 starts. Specifically, when conveying by the registration rollers 46 is started, the leading edge of the recording material P is at the location of the registration sensor 47. Accordingly, since the recording material P is conveyed from that location at a constant velocity, the time until entry into the heating nip portion H can be easily predicted. The power correction time is therefore set based on the start of conveying of the recording material P by the registration rollers 46, which is obtained by an inverse calculation performed using the time when the recording material P enters the heating nip portion H in the actual sequence. Note that although the expression "predict" is used here, this required time is actually a fixed value determined in advance based on the conveying distance and the conveying speed in the apparatus. On the other hand, the power supply rate update time is determined in advance through PID control performed by the CPU 21.

Accordingly, when conveying of the recording material P by the registration rollers 46 has started, it is possible to calculate at what time the recording material P will enter the heating nip portion H, what time the ideal scheduled power correction start time is, and how many msec the time lag until the power supply rate update time is. Predicting the amount of deviation between the ideal power correction time, which is based on the start time of conveying of the recording material P by the registration rollers 46, and the actual power correction time, which is determined based on the power supply rate update time, in this way also enables predicting operations when power correction is actually performed. This enables suppressing the risk that arises in the case where power correction is performed at a deviated time.

For example, in the case where the actual power correction start time deviates so as to be before the set value, the added power in power correction is modified so as to be lower. This mitigates hot offsetting that occurs due to the temperature of the heating film 20 rising earlier than the entry time of the recording material P. Also, in the case where the power correction start time deviates so as to be after the set value, the added power in power correction is modified so as to be higher. This avoids the situation in which the temperature of the heating film 20 suddenly decreases due to the power correction not conforming to the recording material entry, thus enabling suppressing a reduction in temperature. In such a case, it is possible for a change in glossiness to appear at the location in the image corresponding to the boundary between the first rotation and the second rotation of the heating film 20. However, suppressing a reduction in temperature obtains the effect of, for the image as a whole, mitigating a reduction in glossiness in the region corresponding to the second rotation of the heating film 20.

Sequence of Power Control

Figure 5:
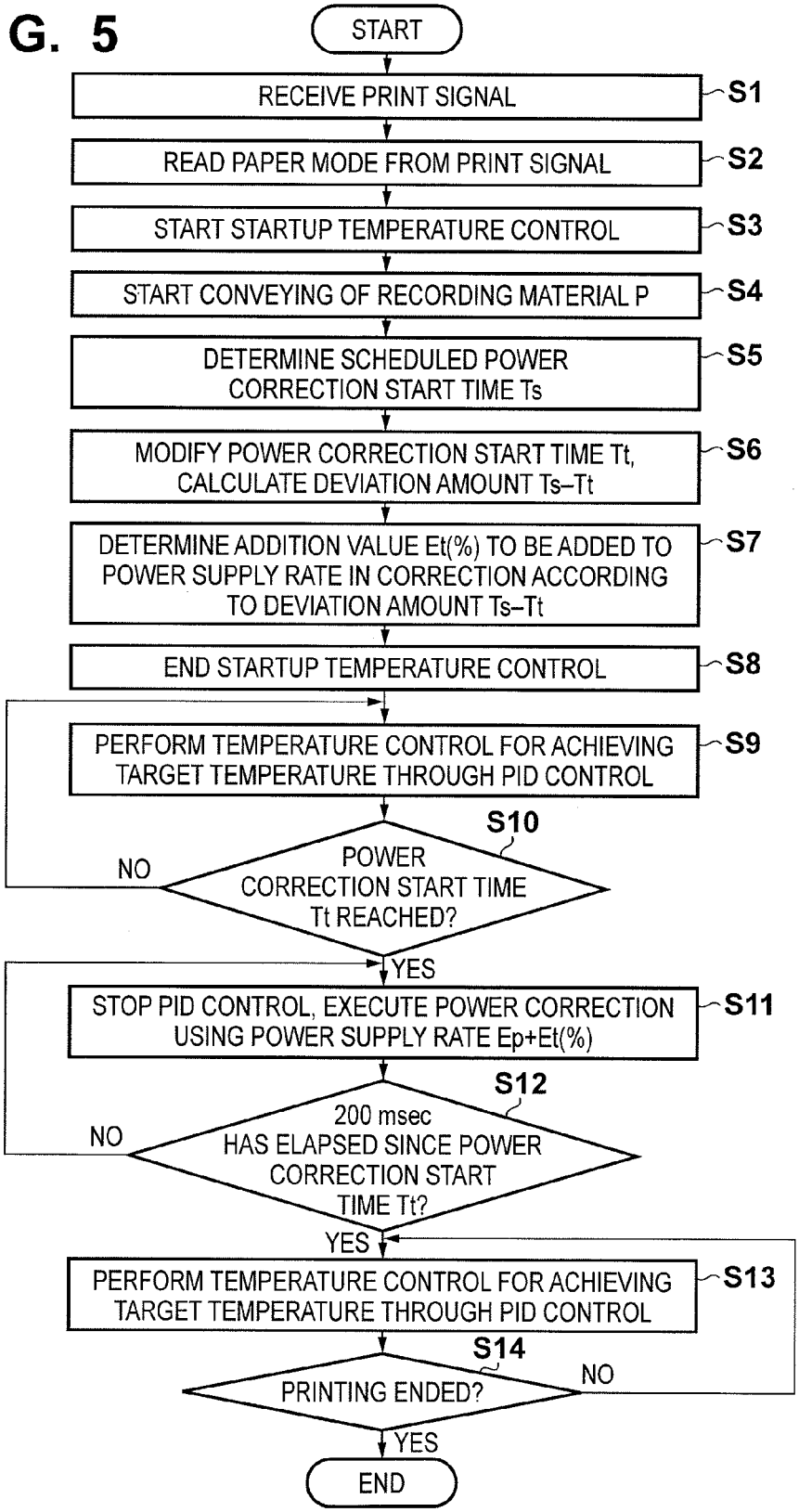
FIG. 5 is a flowchart showing power correction control according to Embodiment 1.

FIG. 5 is a flowchart showing a method of power control in the case of performing printing on one recording material sheet according the present embodiment. The present embodiment is described taking the example of the case where the frequency of the alternating-current power supply 60 that outputs AC power is 50 Hz. In FIG. 5, after the power supply is turned on, the image forming apparatus starts up to state in which a print signal can be received. When the image forming apparatus receives a print command (print signal) from the host computer (not shown) (S1), the CPU 21 reads the paper mode from the print signal (S2). Then, the CPU 21 starts startup temperature control of the heater 16 in order to drive the heater driving circuit unit 28 and raise the temperature of the heating film 20 to the predetermined temperature (S3). Since temperature control of the heater 16 is performed by periodically updating the rate of power supplied to the heater 16, the CPU 21 performs timer setting so as to be able to detect the power supply rate update cycle. Meanwhile, the leading edge of the recording material P is held at the position of the registration rollers 46, and the CPU 21 calculates the conveying start time and then waits. Then, when conveying of the recording material P starts (S4), the CPU 21 determines a scheduled power correction start time Ts based on the time of entry of the recording material P into the heating nip portion H that was automatically determined at the start of conveying (S5).

In the present embodiment, the CPU 21 determines the scheduled power correction start time Ts such that power correction is started using 200 msec before the entry of the recording material P as a reference. The CPU 21 then checks the scheduled power correction start time Ts and the power supply rate update times obtained through timer setting. Then CPU 21 then selects the power supply rate update time (power update time) that is closest to the scheduled power correction start time Ts, as an actual power correction start time Tt, and calculates a deviation amount Ts−Tt (S6). Note that the deviation amount Ts−Tt is a positive value if the power correction start time Tt is before the scheduled power correction start time Ts, and is a negative value if the power correction start time Tt is after the scheduled power correction start time Ts. Next, CPU 21 references the table shown in FIG. 6A, and determines the power supply rate addition value Et (%) for correction that corresponds to the deviation amount Ts−Tt (S7). Here, power supply rate addition values Et (%) for correction that differ according to the paper mode are employed in the table shown in FIG. 6A. Also, the power supply rates Et (%) shown in FIG. 6A are addition values to be added to the power supply rate Ep (%) selected through PID control immediately before power correction starts. Accordingly, it is the addition value to be used in power correction that is determined at this time, and the actual power supply rate is determined immediately before power correction starts. The table shown in FIG. 6A is stored in a storage unit (not shown) in the apparatus. Note that the same applies to other tables described below. When the temperature of the heating film 20 has risen to the vicinity of the predetermined temperature, the CPU 21 ends the startup temperature control (S8), and thereafter sets 190° C., which is the printing temperature, as the target temperature and performs temperature control through PID control (S9).

If the CPU 21 determines, using the timer, that the power correction start time Tt has been reached (Yes in S10), the CPU 21 stops PID control. The CPU 21 then adds the predetermined power supply rate Et (%) to the power supply rate Ep (%) that was used as the power supply for correction in the immediately previous PID control, and executes power correction (S11). The waveform pattern in wave number control at this time is determined according to the waveform patterns in FIG. 4. Then CPU 21 then continues to supply power in accordance with Ep+Et (%) for 200 msec (predetermined period) from the power correction start time Tt (No in S12). Thereafter, if the CPU 21 determines, using the timer, that 200 msec has elapsed since the power correction start time (Yes in S12), the CPU 21 sets the target temperature to 190° C., which is the printing temperature, and performs temperature control through PID control (S13). The CPU 21 continues the above sequence until the end of printing (S14), and ends the temperature control when printing ends. Note that the above-described control procedure can be applied in the case of consecutive printing as well.

Note that although the registration rollers 46 are used as a reference point in the present embodiment, a configuration is possible in which a sensor for detecting the conveying state is separately provided on the upstream side of the heating device 12, and the detection result thereof is used as a reference point. Although only the basis weight is set as the paper mode in the example described above, a difference arising from the surface state of the recording material P or the like may be included in the paper mode. With a recording material called "rough paper" whose recording material surface is not sufficiently smooth, glossy paper with a very high degree of smoothness, and a film-type of recording material such as OHT, the power used in power correction differs due to the fact that the heat capacity and the ability of heat to transfer from the heating device 12 to the recording material P is generally different from ordinary printing paper. Accordingly, more optimum control is possible if the power correction value is set differently according to such types of printing media.

Hybrid Control

Note that although wave number control was used in power supply rate control during power supply, it is possible to use control in which wave number control and phase control are combined. In such control, the power supply rate is controlled in a predetermined cycle that, as in wave number control, has a waveform for always performing 100% power supply or no power supply (0% power supply) with respect to one halfwave in the predetermined cycle, and also includes a waveform for performing phase control by controlling the phase angle with respect to one halfwave in the same cycle. Here, this control is defined as "hybrid control". Specifically, hybrid control is basically wave number control using several halfwaves as a unit, but performing phase control with respect to a number of halfwaves among the multiple halfwaves.

In hybrid control, since a waveform for performing phase control in the control cycle is included, it is possible to set detailed power supply rates, and set the control cycle shorter than the case of controlling the power supply rate with only wave number control. On the other hand, since phase control is performed with only part of the wave of the AC voltage, it is possible to perform setting so as to minimize the increase in harmonic current to a greater degree than the case of controlling the power supply rate with only phase control.

The present embodiment is described taking the example of the case where the power supply rate control cycle is 8 halfwaves. Here, the control cycle (update cycle) is 80 msec in the case where the frequency of the alternating-current power supply is 50 Hz. In the case where normal wave number control is performed in units of 8 halfwaves, the power supply rate can be controlled only in 12.5% increments, and therefore the fluctuation range of the power supplied to the heater 16 increases. As a result, temperature ripples in the heater 16 also increase, and heating unevenness readily appears in an image as glossiness unevenness when performing heating processing on a visualized image. In response to this, in the hybrid control used in the present embodiment, several halfwaves for performing phase control are included among the eight halfwaves so as to enable setting detailed power supply rates even when using units of eight halfwaves. Also, since the power supply rate update cycle during normal operation can be set shorter than the case of performing only wave number control in units of 20 halfwaves, it is possible to perform control that is more stable, has less unevenness, and also reduces flicker noise.

With this hybrid control, although the number of waves per unit (i.e., one control cycle) can be reduced, an excessive reduction causes a rise in the overall proportion of phase control, and thus harmonic current increases. In view of this, setting eight halfwaves as the power supply rate update cycle achieves a balanced setting. Of course this changes depending on the apparatus configuration, and there is no limitation to this setting. Note that as the power supply method of the present embodiment, similarly to the case of wave number control, waveform patterns of AC voltages are set in advance for power supply rates, and power is supplied using a waveform that is in accordance with power supply rate set through PID control.

FIG. 6B shows an example of waveform patterns for each power supply rate. FIG. 6B shows waveform patterns in the case where a total of 21 patterns of waveforms have been set for power supply rates in 5% increments from 0% to 100%. Although the example of power supply rates in 5% increments is described here in order to facilitate the description, the power supply rates can be made more detailed, and it is possible to set power supply rates in increments of 1%, for example. Since halfwaves for performing phase control are included in hybrid control, there is no need to increase the unit of wave number control, regardless of how detailed the power supply rate setting is. Accordingly, in the case of employing hybrid control, the power supply rate can be controlled more finely, thus enabling the supply of power during power correction to also be controlled more finely. With wave number control in 20 halfwaves, power can be set in only units of 5%, and power modification for the deviation amount Ts−Tt can only be performed in units of 5%. However, with hybrid control, power can be modified even in units of 1%, and it is possible to create a table that is even more detailed than the control table shown in FIG. 6A.

Incidentally, in the above-described embodiment, the power correction period was 200 msec, from 200 msec before the entry of the recording material P into the heating nip portion H until 0 msec after the entry. However, since the update cycle is 80 msec in the case of controlling the power supply rate in units of eight halfwaves in hybrid control, time cannot be partitioned into units of 200 msec. Accordingly, the power correction period is made to conform to the power supply rate update cycle, and is set to, for example, 160 msec, from 160 msec before the entry of the recording material P into the heating nip portion H until 0 msec after the entry.

Note that there is no limitation to this numerical value in the power correction timing of the present embodiment. In the present embodiment, power correction is started before entry of the recording material P into the heating nip portion H, and is ended at the same time as the entry. However, a configuration is possible in which, for example, the CPU 21 performs power correction in a period that starts before and ends after the entry of the recording material P into the heating nip portion H. This is superior in terms of compensating for a temporary lack of power due to entry. It is also possible to end power correction after the recording material P has entered. This is clear due to the fact that the power correction period is set based on the assumption that a time lag occurs between when power is supplied to the heater 16 and when the temperature of the heater 16 rises.

As described above, PID control is stopped for a certain period in the vicinity of the time when the recording material P enters the heating nip portion H, and the power supplied to the heater 16 is corrected to a predetermined value and then supplied. Along with this, the amount of deviation between the power correction time determined based on the time when the recording material P enters the heating nip portion H and the time when power correction is actually executed, which is determined based on the power supply rate update time, is checked, and the power supplied during power correction is modified in accordance with this amount of deviation. This enables mitigating hot offsetting and the like that occurs due to deviation of the power correction time, and enables employing a configuration that suppresses harmonic current through wave number control or hybrid control.

According to Embodiment 1, a reduction in image quality can be prevented even in the case were deviation has occurred between the power correction timing and the power supply rate update timing.

Embodiment 2

In the present embodiment, in power correction, the power supply is set differently according to the amount of deviation between the scheduled power correction start time that was set and the time that power correction is actually executed, and waveform patterns different from those used in normal temperature control are used as the waveform patterns for the wave number control that is performed. As shown in FIG. 4, in the waveform patterns used in normal temperature control, on and off are appropriately distributed throughout one update cycle. Distributing on and off in this way allows power to be supplied evenly in the power supply rate update cycle, and is effective in terms of stabilizing control during normal temperature control. However, if the waveform patterns are made even in the update cycle, in the case where the execution time in power correction deviates, power correction is performed in a region in which it is not originally to be performed, in an amount corresponding to the amount of deviation, thus leading to hot offsetting and the like, as described above.

Figure 7A:
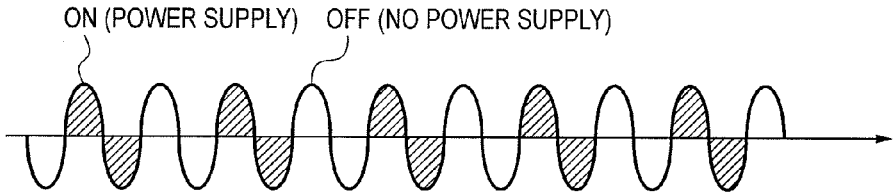
FIGS. 7A to 7C are diagrams showing examples of power supply waveform patterns in wave number control according to Embodiment 2.
Figure 7B:
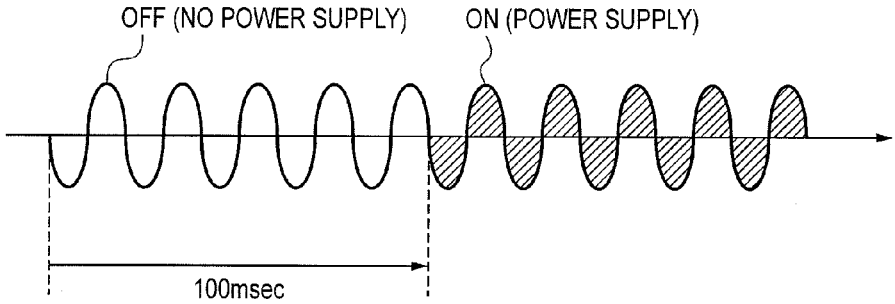

Incidentally, although the power supply is converted using the power supply rate in the update cycle in wave number control, the power that is actually supplied is power supplied in units of halfwaves. Accordingly, off-setting the place where power supply is performed in the update cycle enables controlling the time when power is actually supplied. As examples of this, FIGS. 7A and 7B shows examples of waveform patterns for the power supply rate of 50%. FIG. 7A shows the case where on and off are distributed evenly in 20 halfwaves. FIG. 7B shows the case where power supply is off-set so as to be concentrated in the latter half among the 20 halfwaves. In the case shown in FIG. 7A, power is supplied evenly throughout the 20 halfwaves, whereas in the example shown in FIG. 7B, power supplied is performed only in the latter half, and not in the former half. It is clear that although the power supply rate is 50% in the 20 halfwaves in both cases, the actual power supply state is different. In the example shown in FIG. 7A, the power supply state is a state close to the state where 50% power supply continues evenly throughout the 20 halfwaves, whereas in the example shown in FIG. 7B, 100% power supply is output in the 10 halfwaves in the latter half. In other words, power supply is actually started at a time that is 100 msec later than that in the example shown in FIG. 7A. Such waveform patterns enable setting the power supply time differently to a certain extent. In the present embodiment, if the power correction time has deviated, the power supply is modified according to amount of deviation, and a waveform pattern that conforms to the amount of deviation is used. Selecting the waveform pattern according to the amount of deviation in this way enables substantially lowering the power supply rate at a time when excessive power supply is to be prevented in the update cycle in wave number control, and distributing power supply so as to be concentrated at a time when power supply is to be performed.

Sequence of Power Control

Figure 8:
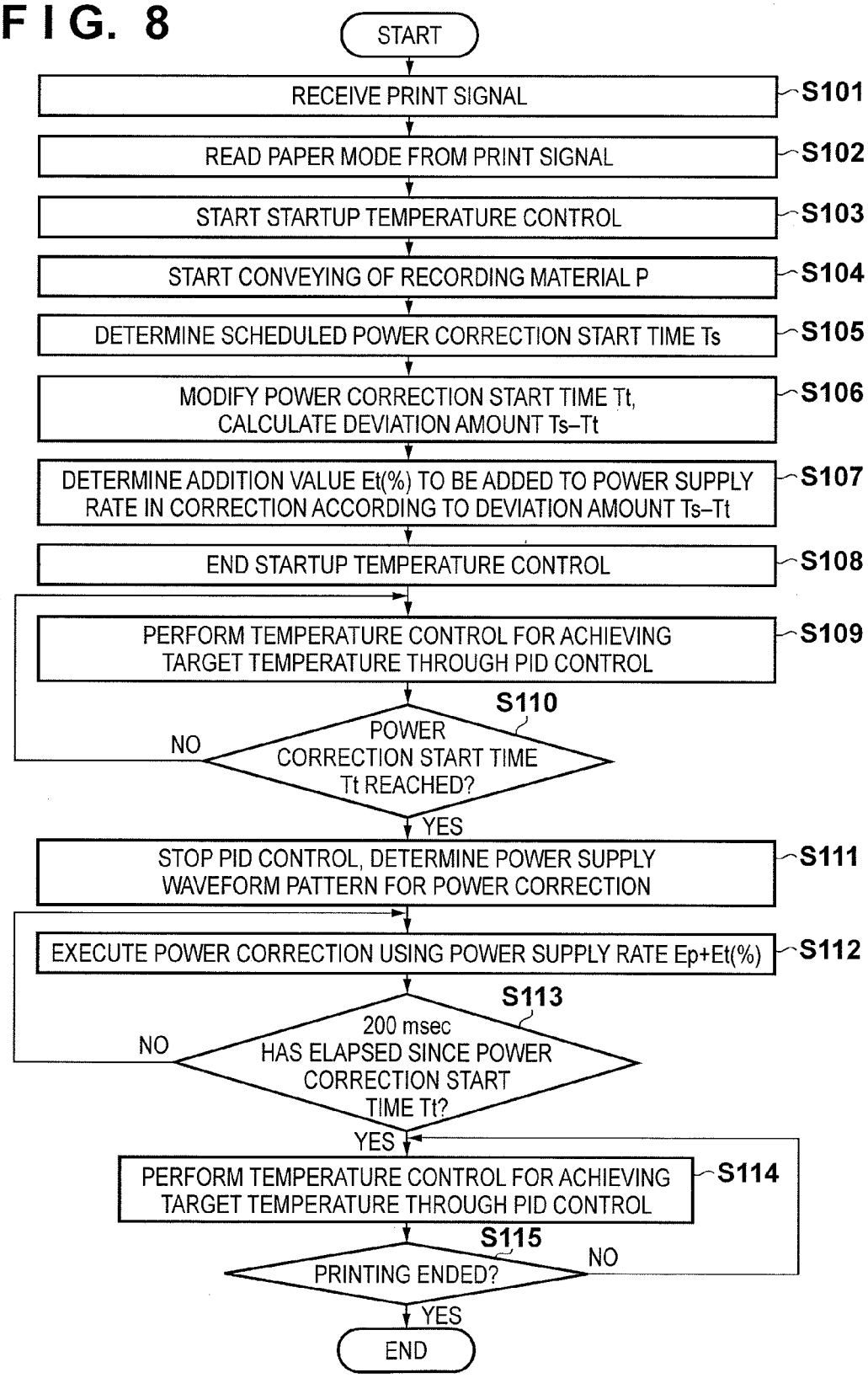
FIG. 8 is a flowchart showing power correction control according to Embodiment 2.

The following describes the power control method of the present embodiment with reference to the flowchart shown in FIG. 8. FIG. 8 is a flowchart showing a procedure of power correction control in the case of having printed one recording material sheet according to the present embodiment. In the flowchart of FIG. 8, a description of S101 to S106 has been omitted since they are the same as S1 to S6 in the flowchart of FIG. 5 in Embodiment 1, and the following describes steps S107 and onward.

The CPU 21 in the printer determines an addition value Et (%) to be added to the power supply rate in correction according to the deviation amount Ts−Tt, with reference to the table shown in FIG. 9 (S107). Similarly to Embodiment 1, FIG. 9 also shows power supply rates Et (%) that are to be added to the power supply rate Ep (%) selected through PID control immediately before the start of power correction. When the temperature of the heating film 20 reaches the vicinity of the predetermined temperature, and startup temperature control ends (S108), the CPU 21 sets 190° C., which is the printing temperature, as the target temperature, and performs temperature control for achieving the target temperature through PID control (S109). Then, if the CPU 21 has determined, using the timer, that the power correction start time Tt has been reached (S110), the CPU 21 stops PID control, and calculates Ep+Et (%) ("total power supply rate" in the figures) by adding the power supply rate Et (%) to the power control rate Ep (%) obtained immediately previously in PID control. The CPU 21 then determines a waveform pattern shown in FIGS. 10A to 10E based on the calculated result and the deviation amount Ts−Tt (S111). Note that although the waveform patterns shown in FIGS. 10A to 10E are waveform patterns for wave number control, it is also possible to use a waveform pattern for hybrid control that was described in Embodiment 1.

The CPU 21 then executes power correction so as to supply predetermined power at the predetermined power supply rate Ep+Et (%) for 200 msec from the power correction start time Tt in accordance with the waveform pattern determined in S111 (S112). Thereafter, the CPU 21 determines, using the timer, whether 200 msec has elapsed since the power correction start time Tt (S113), and if 200 msec has elapsed, the CPU 21 sets the target temperature to 190° C., which is the printing temperature, and performs temperature control through PID control (S114). If 200 msec has not elapsed, the procedure returns to S112.

Figure 7C:
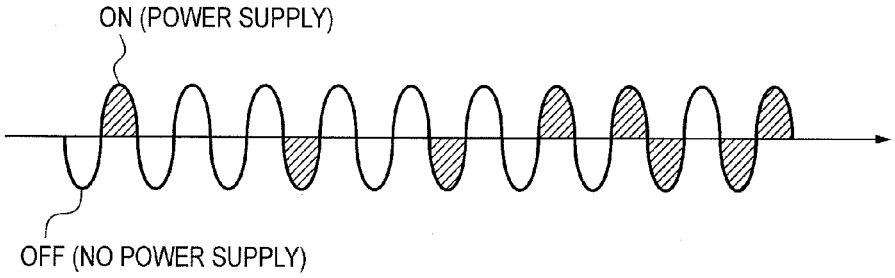

The CPU 21 continues the above sequence until the end of printing (S115), and ends the temperature control when printing ends. Note that the above-described control procedure can be applied in the case of consecutive printing as well. Also, the following describes the reason why the values in the control shown in FIG. 9 are different from the values in the control table shown in FIG. 6A in Embodiment 1. The power supply rates that are added in the control table shown in FIG. 6A are set based on the assumption that power is supplied evenly in the update period during power correction. However, in the case where the waveform patterns are set differently as in the present embodiment, it is necessary to change the power supply rate in one update cycle in accordance with the amount that the power supply time actually changes. This is described below based on the above-described example of the power supply rate of 50%. In the case of replacing the waveform pattern shown in FIG. 7A, in which power is supplied evenly throughout 20 halfwaves, with the waveform pattern shown in FIG. 7B, 100% of the power supply rate is in the 10 halfwaves of the latter half, and the power supply is clearly excessive here. Also, it is not appropriate for the power supply rate to be 0% in all of the 10 halfwaves of the former half. Accordingly, even if the power supply time is off-set to the 10 halfwaves of the latter half, the waveform pattern is to have balance, such as that shown in FIG. 7C, for example. In the case where the power supply time is adjusted by using different waveform patterns in this way, the power supply rate is not always the same in one update cycle. For example, the power supply rate in FIG. 7C is 40%.

Figure 11:
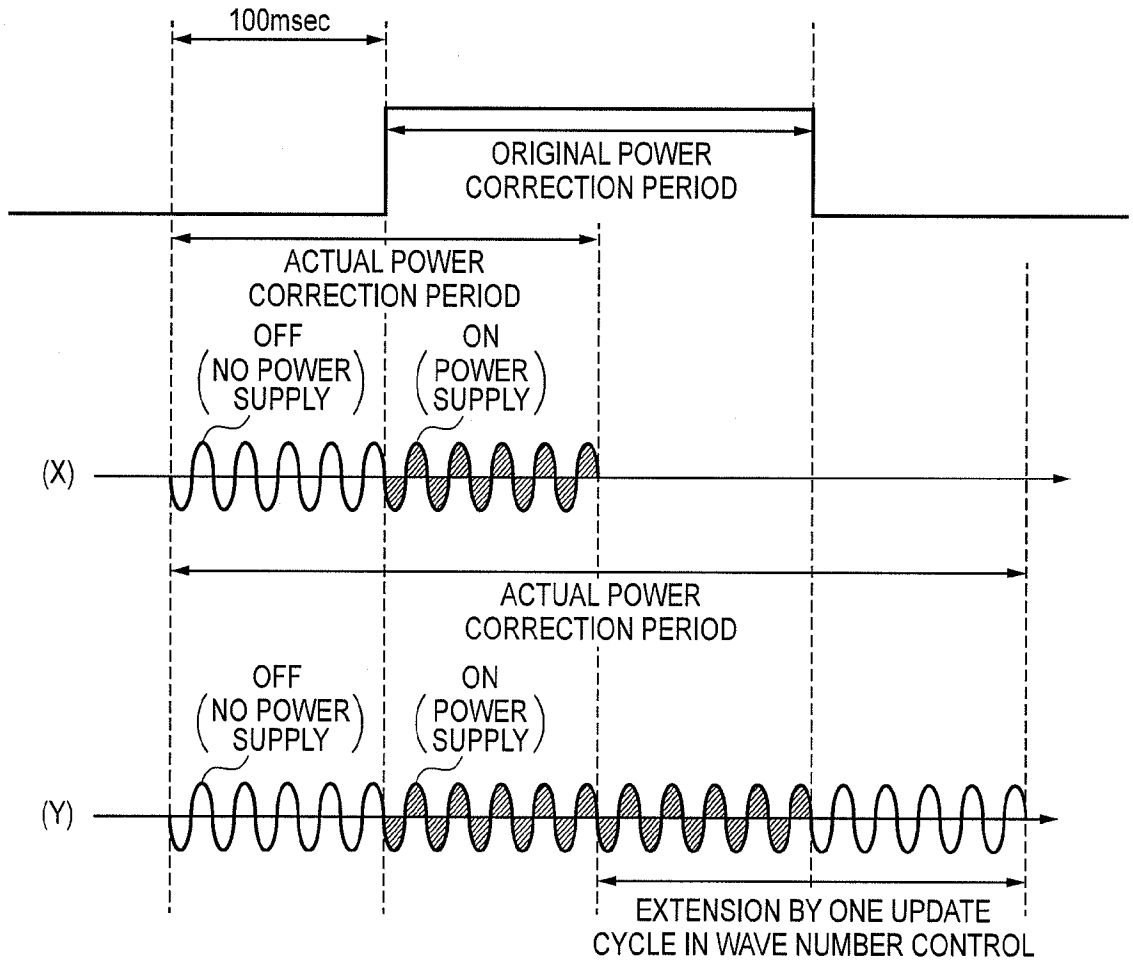
FIG. 11 is a diagram showing an example of power supply waveform patterns in wave number control according to Embodiment 2.

Incidentally, in the above example based on Embodiment 1, the power correction period is a 200 msec period from 200 msec before the entry of the recording material P into the heating nip portion H until 0 msec has elapsed since the entry of the recording material P. This is because an optimum value has been selected as the power correction period. In contrast to this, in the present embodiment, in the case where there is deviation between the power correction time and the time when power correction is actually executed, the power correction period is increased by one update cycle for power, and the waveform pattern for that period is set differently, thus enabling achieving further conformity with the actual power supply time. This is described more specifically below with reference to FIG. 11. Note that FIG. 11 shows an example in which the power supply waveform is highly off-set as in FIG. 7B, for ease of understanding. In FIG. 11, (X) indicates the case where the actual power correction time is deviated so as to be 100 msec before the original power correction time. At this time, the actual power supply time approaches the original power correction time, and therefore the method employing a waveform pattern for supplying power off-set in the 100 msec of the latter half during power correction is used, as described above. However, since the power correction period is deviated so as to be 100 msec early in this case, power correction can only be performed in the 100 msec of the former half of the original power correction period. Accordingly, the 100 msec of the latter half in which power correction cannot be performed becomes an insufficiency in terms of resolving the problem of a change in glossiness.

In view of this, in the case where the power correction time deviates in this way, the power correction period is extended by one update cycle for power, and the waveform pattern for that period is appropriately selected, thereby supplying desired power in the original power correction period. This is advantageous in resolving the problem of a difference in glossiness as well.

In FIG. 11, (Y) indicates the case where, when the power correction period has deviated so as to be 100 msec before the original 200 msec power correction period, the power correction period is extended on the latter half side by one update cycle, that is to say, by 200 msec. Specifically, the power correction becomes a total of 400 msec (200 msec+200 msec), and the power supply rate update cycle corresponds to two cycles. Also, in this case, in the power correction period corresponding to two power updating cycles, the power supply waveform is off-set to the latter half in the first cycle, and the power supply waveform is off-set to the former half in the next cycle. This enables performing actual power supply at a time near the original power correction period. In the present embodiment, since the original power correction period matches one cycle-worth of the power supply rate update cycle, the power correction period becomes doubled to two update cycles when extended as described above, but basically one update cycle is added to the original power correction period. For example, if the original power correction period corresponds to three update cycles, the extended power correction period corresponds to four update cycles.

Incidentally, when such a configuration is employed, it is pointless if the actual start of correction is excessively delayed from the scheduled power correction start time. Accordingly, if the power correction time becomes deviated, basically the power supply rate update time that is before and closest to the scheduled power correction start time is set as the actual power correction start time. In other words, the actual power correction start time is set so as to be a time before the original scheduled power correction start time. However, if the actual power correction start is delayed by a small amount from the scheduled power correction start time, the deviation of the time has little influence. Accordingly, in such a case, power correction is performed at the power correction start time without modification, and there is no need to increase the power correction period. For the same reason there is also no need to increase the power correction period in the case where there is little deviation in the power correction time as a result of re-setting the power correction start time.

Another Sequence of Power Control

Figure 12:
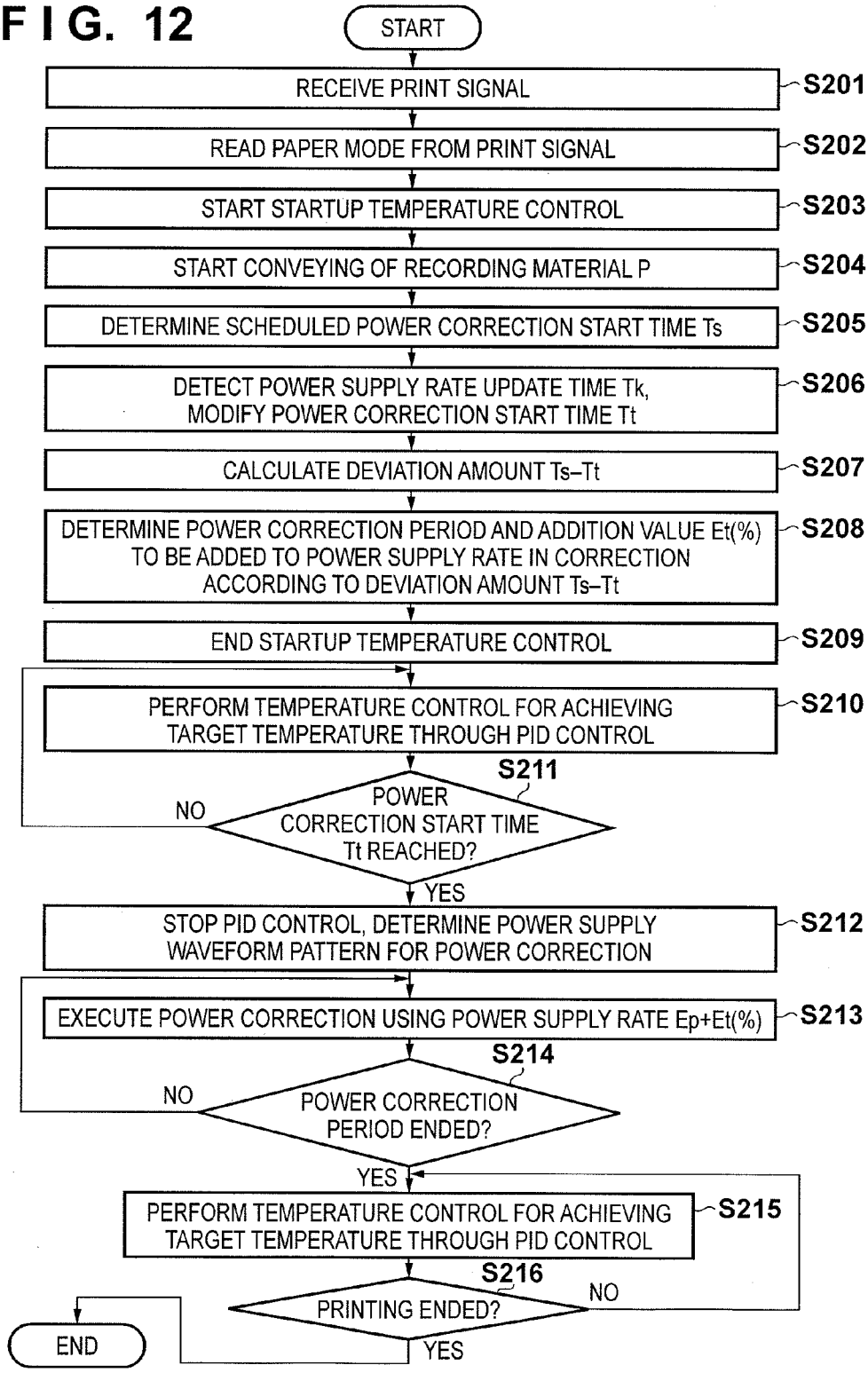
FIG. 12 is a flowchart showing power correction control according to Embodiment 2.
Figure 15:
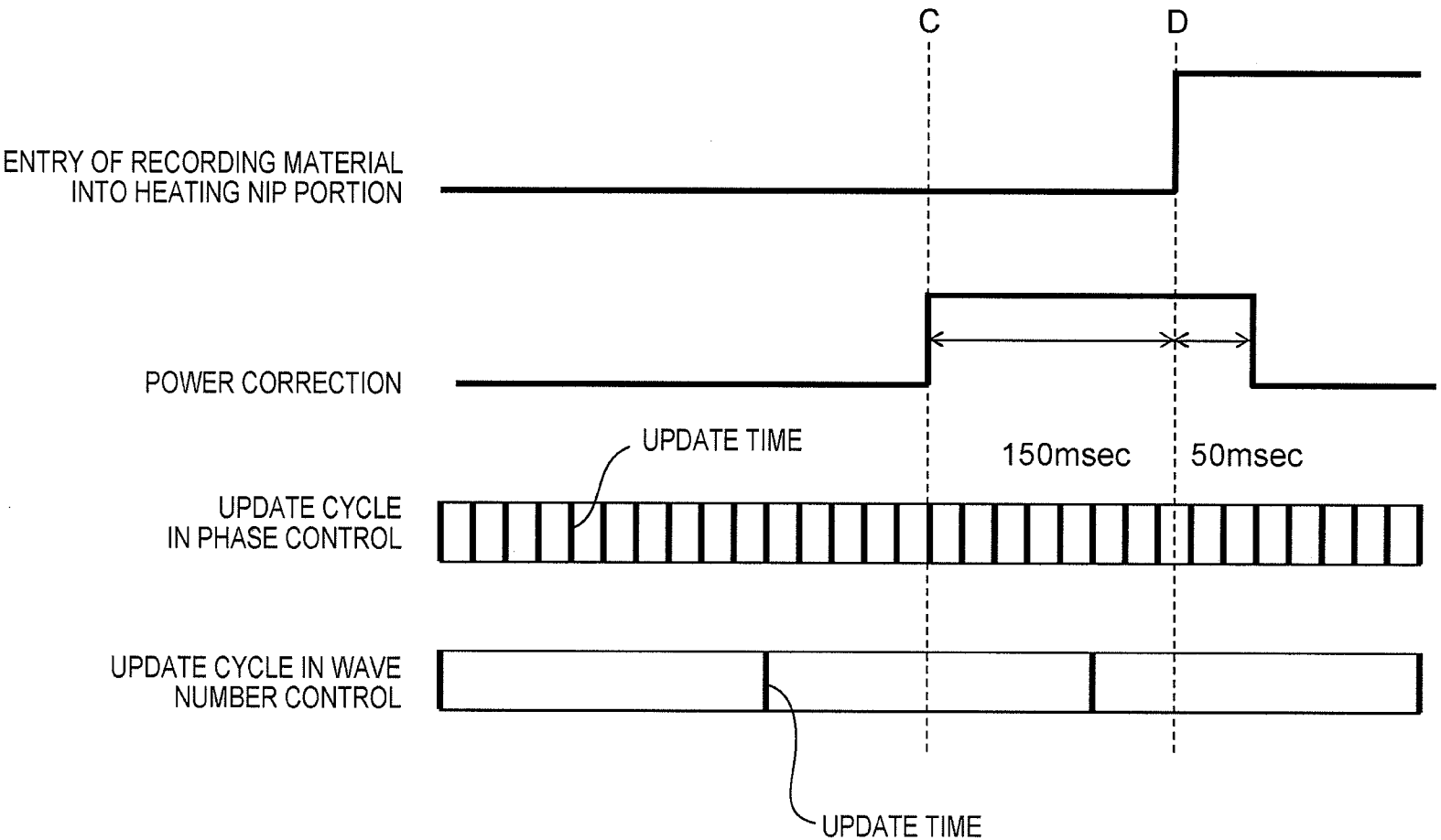
FIG. 15 is a timing chart showing the power supply rate update cycle in wave number control and phase control, and the timing of recording material entry and power correction according to conventional technology.
Figure 16A:
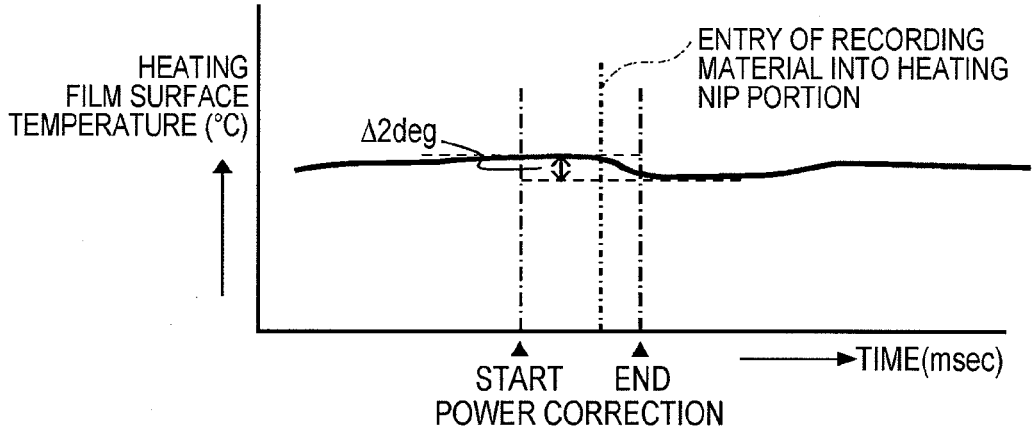
FIGS. 16A to 16C are graphs showing change in the temperature of a heating film surface according to conventional technology.
Figure 16B:
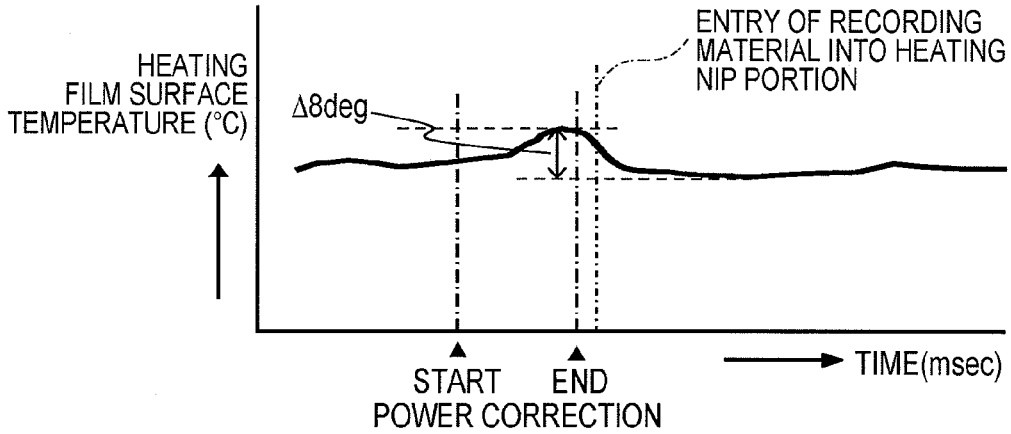
Figure 16C:
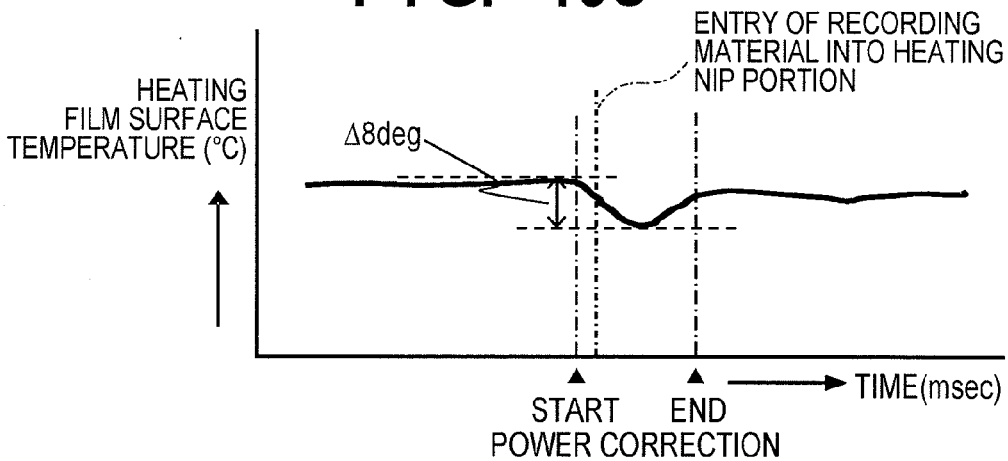

The following describes actual correction operations when one recording material sheet has been printed in the case of applying the above configuration, with reference to the flowchart of FIG. 12 showing a power control method. The present embodiment is described taking the example of the case where the frequency of the alternating-current power supply 60 is 50 Hz. In FIG. 12, a description of S201 to S205 has been omitted since they are the same as S1 to S5 in FIG. 5 of Embodiment 1, and the following describes steps S206 and onward.

The CPU 21 checks the scheduled power correction start time Ts and the power supply rate update time obtained through timer setting, and detects the power supply rate update time Tk that is closest to the scheduled power correction start time Ts (S206). Here, in the case where −30 msec≤(Ts−Tk), the CPU 21 sets Tt=Tk as the power correction start time Tt without modification (S206). Here, the power correction start time Tt is after the original scheduled power correction start time Ts if −30 msec≤(Ts−Tk)<0 msec, and is before the original scheduled power correction start time Ts if 0 msec≤(Ts−Tk). On the other hand, if −100 msec≤(Ts−Tk)<−30 msec, the CPU 21 modifies Tt so as to be Tt=Tk−200 msec (S206). Accordingly, the power correction start time Tt is set to a time before the original scheduled power correction start time Ts. The CPU 21 then calculates the deviation amount Ts−Tt of the actual power correction start time Tt (S207). Note that Ts−Tt does not become a value smaller than −30 msec as a result of the calculation based on Tk. In accordance with the deviation amount Ts−Tt, the CPU 21 determines the addition value Et (%) to be added to the power supply rate in correction that corresponds to the paper mode, with reference to the table shown in FIG. 13 (S208).

Here, the power correction period is also determined at the same time. If the deviation amount Ts−Tt is less than 30 msec, the power correction period is set to 200 msec ("correction period extension: no" in FIG. 13), and if the deviation amount Ts−Tt is greater than or equal to 30 msec, the power correction period is extended by an amount corresponding to one power supply rate update cycle ("correction period extension: yes" in FIG. 13). In the present embodiment, this corresponds to two power supply rate update cycles, which is 400 msec. If the power correction period is extended in this way, there are cases where the CPU 21 causes the power supply rate to be different in the first cycle and the second cycle. This is done in order to supply power with the power supply waveform being off-set in the original power correction period. In order to cause the power supply to be concentrated in the original power correction period, the power supply waveform is off-set in the latter half of the first cycle and the former half of the second cycle, but at this time, the length including the original power correction period is different between the first cycle and the second cycle. If the length corresponding to the original power correction period is different between the first cycle and the second cycle, the power supply rate is of course higher in the cycle including more of the original power correction period. Accordingly, the power supply rate needs to be set differently in the first cycle and the second cycle. In consideration of this, power supply rates in a power correction period obtained by combining the first cycle and the second cycle are shown in the table of FIG. 13 in the present embodiment. The actual power supply rates in the first cycle and the second cycle are determined at the time of selection of a waveform pattern in FIGS. 14A to 14E, which is described below. When the temperature of the heating film 20 reaches the vicinity of the predetermined temperature, and startup temperature control ends (S209), the CPU 21 sets 190° C., which is the printing temperature, as the target temperature, and performs temperature control for achieving the target temperature through PID control (S210). Then, if the CPU 21 has determined, using the timer, that the power correction start time Tt has been reached (Yes in S211), the CPU 21 stops PID control, and calculates Ep+Et (%) by adding Et (%) to the power supply rate Ep (%) obtained immediately previously in PID control. Then, waveform patterns in FIGS. 14A to 14E are determined based on the calculation result and the deviation amount Ts−Tt (S212). Note that although the waveform patterns shown in FIGS. 14A to 14E are waveform patterns for wave number control, it is also possible to use a waveform pattern for hybrid control that was described in Embodiment 1.

The waveform patterns in FIGS. 14A to 14E are respectively determined for the first cycle and the second cycle in accordance with total power supply rates Ep+Et in the correction period. In other words, here, the allocation of the power supply rate in the first cycle and the second cycle is determined. Then, the CPU 21 executes power correction using the predetermined power supply rate Ep+Et (%) in accordance with the waveform pattern determined in S212, and continues the power correction for the power correction period determined in S208 while performing counting with the timer (S213 and S214). Note that in the case of a relatively high or high low power supply rate in FIGS. 14A to 14E, there are many regions of consecutive on or off in the AC waveform, and there is the possibility of the heater temperature become unstable. However, this is merely the setting of a table in data, and the power supply rate that is actually selected in power correction is not such an extreme rate. The temperature therefore does not actually become unstable in power correction. Thereafter, when the power correction period ends, the CPU 21 sets 190° C., which is the printing temperature, as the target temperature, and performs temperature control through PID control (S214 and S215). The CPU 21 continues the above operations until the end of printing (S216), and ends the temperature control when printing ends. Note that the above-described control procedure can be applied in the case of consecutive printing as well.

As described above, in the present embodiment, in accordance with the deviation amount Ts−Tt between the power correction time and the time when power correction is actually executed, the power supply in power correction is modified, and an appropriate power supply waveform pattern is selected in wave number control. Also, the power correction period is extended in accordance with the deviation amount Ts−Tt. This enables the actual power supply time to approach the original power correction period even if the power correction time has become deviated. Also, compared to Embodiment 1, there is an even greater effect of suppressing hot offsetting and the like that occurs due to deviation of the power correction time, and a difference in glossiness in an image between the first rotation and the second rotation of the heating film can be suppressed even further.

According to Embodiment 2, a reduction in image quality can be prevented even in the case were deviation has occurred between the power correction timing and the power supply rate update timing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-274587, filed Dec. 9, 2010, which is hereby incorporated by reference herein in its entirety.

What is claimed is:

1. An image forming apparatus comprising:

an image forming unit that forms an unfixed toner image on a recording material;

a fixing unit that fixes the unfixed toner image on the recording material onto the recording material by heat;

a temperature detection unit that detects the temperature of the fixing unit; and a control unit that controls the image forming apparatus, wherein the control unit updates the power supplied from an alternating-current power supply to the fixing unit to a power in accordance with the temperature detected by the temperature detection unit per a power update period prescribed by a predetermined number of consecutive halfwaves of the alternating-current power supply, and wherein the control unit corrects the power supplied to the fixing unit at a time when the recording material enters the fixing unit with a correction power based on the difference between an update time of the power updating period and the time when the recording material enters the fixing unit.

2. The image forming apparatus according to claim 1, wherein the fixing unit has an endless belt, a heater that is in contact with an inner surface of the endless belt, and a pressure roller that forms, along with the heater via the endless belt, a nip portion where fixing processing is performed on the recording material on which the unfixed toner image has been formed, and the power from the alternating-current power supply is supplied to the heater.

3. The image forming apparatus according to claim 1, wherein the control unit executes wave number control so as to cause the number of waves for power supply to be different in the former half and the latter half of a power correction period in which the power supply is corrected, and furthermore extends the power correction period by an amount corresponding to one power updating period.

4. The image forming apparatus according to claim 3, wherein the control unit increases the power supply rate in the latter half of a preceding first power correction period in the extended power correction period, and increases the power supply rate in the former half of a second power correction period that succeeds the first power correction period.

* * * * *